US008421356B1

(12) United States Patent
Wedding

(10) Patent No.: US 8,421,356 B1
(45) Date of Patent: Apr. 16, 2013

(54) MICROSHELL GAS DISCHARGE DEVICE

(75) Inventor: Carol Ann Wedding, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 0 days.

(21) Appl. No.: 13/366,543

(22) Filed: Feb. 6, 2012

Related U.S. Application Data

(60) Division of application No. 12/275,535, filed on Nov. 21, 2008, now Pat. No. 8,110,987, and a continuation-in-part of application No. 12/275,535, filed on Nov. 21, 2008, now Pat. No. 8,110,987, which is a division of application No. 10/431,446, filed on May 8, 2003, now Pat. No. 7,456, 571.

(60) Provisional application No. 60/381,822, filed on May 21, 2002.

(51) Int. Cl.
*H01J 17/49* (2012.01)

(52) U.S. Cl.
USPC ..... 313/582

(58) Field of Classification Search ..... 313/582–587
See application file for complete search history.

(56) References Cited

U.S. PATENT DOCUMENTS 6,864,631 B1 * 3/2005 Wedding ..... 313/587
8,110,987 B1 * 2/2012 Wedding ..... 313/582

* cited by examiner

*Primary Examiner* — Joseph L Williams
(74) *Attorney, Agent, or Firm* — Donald K. Wedding

(57) ABSTRACT

A gas discharge device with a multiplicity of gas filled microshells positioned on a single substrate in electrical contact with one or more electrodes. Each microshell may contain a luminescent material.

14 Claims, 24 Drawing Sheets

| Electrical Map | | Data Electrodes | | | | | | | | | | |
|---|---|---|---|---|---|---|---|---|---|---|---|---|
| | | l1 | l2 | l3 | l4 | l5 | l6 | l7 | l8 | l9 | | |
| | | m1 | m2 | m3 | m4 | m5 | m6 | m7 | m8 | m9 | | |
| Address Electrodes (scan electrodes) | n1 | n1,l1 | n1,l2 | n1,l3 | n1,l4 | n1,l5 | n1,l6 | n1,l7 | n1,l8 | n1,l9 | R1 | Rows |
| | n2 | n2,l1 | n2,l2 | n2,l3 | n2,l4 | n2,l5 | n2,l6 | n2,l7 | n2,l8 | n2,l9 | R2 | |
| | n3 | n3,l1 | n3,l2 | n3,l3 | n3,l4 | n3,l5 | n3,l6 | n3,l7 | n3,l8 | n3,l9 | R3 | |
| | n4 | n4,l1 | n4,l2 | n4,l3 | n4,l4 | n4,l5 | n4,l6 | n4,l7 | n4,l8 | n4,l9 | R4 | |
| | n5 | n5,l1 | n5,l2 | n5,l3 | n5,l4 | n5,l5 | n5,l6 | n5,l7 | n5,l8 | n5,l9 | R5 | |
| | n6 | n6,l1 | n6,l2 | n6,l3 | n6,l4 | n6,l5 | n6,l6 | n6,l7 | n6,l8 | n6,l9 | R6 | |
| | n7 | n7,l1 | n7,l2 | n7,l3 | n7,l4 | n7,l5 | n7,l6 | n7,l7 | n7,l8 | n7,l9 | R7 | |
| | n8 | n8,l1 | n8,l2 | n8,l3 | n8,l4 | n8,l5 | n8,l6 | n8,l7 | n8,l8 | n8,l9 | R8 | |
| | | C1 | C2 | C3 | C4 | C5 | C6 | C7 | C8 | C9 | | |
| | | Column | | | | | | | | | Physical Map | |

| | scan | Physical Map | | | | | | | | |
|---|---|---|---|---|---|---|---|---|---|---|
| | 1 | R1,C1 | R1,C2 | R1,C3 | R1,C4 | R1,C5 | R1,C6 | R1,C7 | R1,C8 | R1,C9 |
| | | R5,C1 | R5,C2 | R5,C3 | R5,C4 | R5,C5 | R5,C6 | R5,C7 | R5,C8 | R5,C9 |
| | | | | | | | | | | |
| | 2 | R2,C1 | R2,C2 | R2,C3 | R2,C4 | R2,C5 | R2,C6 | R2,C7 | R2,C8 | R2,C9 |
| | | R6,C1 | R6,C2 | R6,C3 | R6,C4 | R6,C5 | R6,C6 | R6,C7 | R6,C8 | R6,C9 |

FIG. 3A

| Electrical Map | | Data Electrodes | | | | | | | | | | |
|---|---|---|---|---|---|---|---|---|---|---|---|---|
| | | m1 | m2 | m3 | m4 | m5 | m6 | m7 | m8 | m9 | | |
| Address Electrodes (scan electrodes) | n1 | n1,m1 | n3,m2 | n1,m3 | n3,m4 | n1,m5 | n3,m6 | n1,m7 | n3,m8 | n1,m9 | R1 | Rows |
| | n2 | n2,m1 | n4,m2 | n2,m3 | n4,m4 | n2,m5 | n4,m6 | n2,m7 | n4,m8 | n2,m9 | R2 | |
| | n3 | n3,m1 | n1,m2 | n3,m3 | n1,m4 | n3,m5 | n1,m6 | n3,m7 | n1,m8 | n3,m9 | R3 | |
| | n4 | n4,m1 | n2,m2 | n4,m3 | n2,m4 | n4,m5 | n2,m6 | n4,m7 | n2,m8 | n4,m9 | R4 | |
| | n5 | n5,m1 | n7,m2 | n5,m3 | n7,m4 | n5,m5 | n7,m6 | n5,m7 | n7,m8 | n5,m9 | R5 | |
| | n6 | n6,m1 | n8,m2 | n6,m3 | n8,m4 | n6,m5 | n8,m6 | n6,m7 | n8,m8 | n6,m9 | R6 | |
| | n7 | n7,m1 | n5,m2 | n7,m3 | n5,m4 | n7,m5 | n5,m6 | n7,m7 | n5,m8 | n7,m9 | R7 | |
| | n8 | n8,m1 | n6,m2 | n8,m3 | n6,m4 | n8,m5 | n6,m6 | n8,m7 | n6,m8 | n8,m9 | R8 | |
| | | C1 | C2 | C3 | C4 | C5 | C6 | C7 | C8 | C9 | | |
| | | Column | | | | | | | | | Physical Map | |

| | scan | Physical Map | | | | | | | | |
|---|---|---|---|---|---|---|---|---|---|---|
| | 1 | R1,C1 | R3,C2 | R1,C3 | R3,C4 | R1,C5 | R3,C6 | R1,C7 | R3,C8 | R1,C9 |
| | 2 | R2,C1 | R4,C2 | R2,C3 | R4,C4 | R2,C5 | R4,C6 | R2,C7 | R4,C8 | R2,C9 |
| | 3 | R3,C1 | R1,C2 | R3,C3 | R1,C4 | R3,C5 | R1,C6 | R3,C7 | R1,C8 | R3,C9 |
| | 4 | R4,C1 | R2,C2 | R4,C3 | R2,C4 | R4,C5 | R2,C6 | R4,C7 | R2,C8 | R4,C9 |

FIG. 3B

| Electrical Map | | Data Electrodes | | | | | | | | | | |
|---|---|---|---|---|---|---|---|---|---|---|---|---|
| | | m1 | m2 | m3 | m4 | m5 | m6 | m7 | m8 | m9 | | |
| Address Electrodes (scan electrodes) | n1 | n1,m1 | n4,m2 | n3,m3 | n2,m4 | n1,m5 | n4,m6 | n3,m7 | n2,m8 | n1,m9 | R1 | Rows |
| | n2 | n2,m1 | n1,m2 | n4,m3 | n3,m4 | n2,m5 | n1,m6 | n4,m7 | n3,m8 | n2,m9 | R2 | |
| | n3 | n3,m1 | n2,m2 | n1,m3 | n4,m4 | n3,m5 | n2,m6 | n1,m7 | n4,m8 | n3,m9 | R3 | |
| | n4 | n4,m1 | n3,m2 | n2,m3 | n1,m4 | n4,m5 | n3,m6 | n2,m7 | n1,m8 | n4,m9 | R4 | |
| | n5 | n5,m1 | n8,m2 | n7,m3 | n6,m4 | n5,m5 | n8,m6 | n7,m7 | n6,m8 | n5,m9 | R5 | |
| | n6 | n6,m1 | n5,m2 | n8,m3 | n7,m4 | n6,m5 | n5,m6 | n8,m7 | n7,m8 | n6,m9 | R6 | |
| | n7 | n7,m1 | n6,m2 | n5,m3 | n8,m4 | n7,m5 | n6,m6 | n5,m7 | n8,m8 | n7,m9 | R7 | |
| | n8 | n8,m1 | n7,m2 | n6,m3 | n5,m4 | n8,m5 | n7,m6 | n6,m7 | n5,m8 | n8,m9 | R8 | |
| | | C1 | C2 | C3 | C4 | C5 | C6 | C7 | C8 | C9 | | |
| | | Column | | | | | | | | | Physical Map | |

| | scan | Physical Map | | | | | | | | |
|---|---|---|---|---|---|---|---|---|---|---|
| | 1 | R1,C1 | R2,C2 | R3,C3 | R4,C4 | R1,C5 | R2,C6 | R3,C7 | R4,C8 | R1,C9 |
| | 2 | R2,C1 | R3,C2 | R4,C3 | R1,C4 | R2,C5 | R3,C6 | R4,C7 | R1,C8 | R2,C9 |
| | 3 | R3,C1 | R4,C2 | R1,C3 | R2,C4 | R3,C5 | R4,C6 | R1,C7 | R2,C8 | R3,C9 |
| | 4 | R4,C1 | R1,C2 | R2,C3 | R3,C4 | R4,C5 | R1,C6 | R2,C7 | R3,C8 | R4,C9 |

FIG. 3C

MICROSHELL GAS DISCHARGE DEVICE

RELATED APPLICATIONS

This application is a division and continuation-in-part under 35 U.S.C. 120 of U.S. patent application Ser. No. 12/275,535 filed Nov. 21, 2008, to issue as U.S. Pat. No. 8,110,987 which is a division under 35 U.S.C. 120 from U.S. patent application Ser. No. 10/431,446, filed May 8, 2003, issued as U.S. Pat. No. 7,456,571 which claims priority under 35 USC 119(e) of Provisional Patent Application 60/381,822 filed May 21, 2002, all incorporated herein by reference.

FIELD OF THE INVENTION

This invention relates to a gas discharge device structure wherein an ionizable gas is confined within an enclosure and is subjected to sufficient voltage(s) to cause the gas to discharge. This invention particularly relates to a single substrate gas discharge device such as a plasma display panel (PDP) and the use of microshells to encapsulate the cell structure and simplify the method of production. This invention is particularly suitable for producing flexible or bendable displays. When used in a PDP, a microshell is called a plasma-shell. Each microshell is located on the surface of a single substrate and connected to one or more electrodes.

BACKGROUND

In a gas discharge plasma display, a single addressable picture element is a cell, sometimes referred to as a pixel. The cell element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell, subcell, pixel or subpixel. As used herein, cell or pixel means cell, subcell, pixel, or subpixel.

To form a display image, several types of voltage pulses may be used to address a plasma display. These pulses include a write pulse, which is the voltage potential sufficient to ionize the gas at the pixel site. A write pulse is selectively applied across selected cell sites. The ionized gas will produce visible light, or UV light which excites a phosphor to glow. Sustain pulses are a series of pulses that produce a voltage potential across pixels to maintain ionization of cells previously ionized. An erase pulse is used to selectively extinguish ionized pixels.

The voltage at which a pixel will ionize, sustain, and erase depends on a number of factors including the distance between the electrodes, the composition of the ionizing gas, and the pressure of the ionizing gas. Also of importance is the dielectric composition and thickness. To maintain uniform electrical characteristics throughout the display, it is desired that the various physical parameters adhere to required tolerances. Maintaining the required tolerance depends on cell geometry, fabrication methods, and the materials used. The prior art discloses a variety of plasma display structures, a variety of methods of construction, and materials.

Examples of gas discharge (plasma) devices contemplated in the practice of this invention include both monochrome (single color) AC plasma displays and multi-color (two or more colors) AC plasma displays. Also monochrome and multi-color DC plasma displays are contemplated.

Examples of monochrome AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multi-color AC plasma displays are well known in the prior art and include those disclosed in U.S. Pat. Nos. 4,233,623 (Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489

(Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber), and 5,793,158 (Wedding), all incorporated herein by reference.

Examples of DC gas discharge (plasma) displays are well known in the prior art and include those disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

This invention is described hereinafter with reference to an AC plasma display. The PDP industry has used two different AC plasma display panel (PDP) structures, the two-electrode columnar discharge structure, and the three-electrode surface discharge structure.

The two-electrode columnar discharge display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge structure has been widely used in monochrome AC plasma displays that emit orange or red light from a neon gas discharge. Phosphors may be used in a monochrome structure to obtain a color other than neon orange.

In a multi-color columnar discharge (PDP) structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding '158, each light emitting pixel is defined by a gas discharge between a bottom or rear electrode x and a top or front opposite electrode y, each cross-over of the two opposing arrays of bottom electrodes x and top electrodes y defining a pixel or cell.

The three-electrode multi-color surface discharge AC plasma panel structure is widely disclosed in the prior art including U.S. Pat. Nos. 5,661,500 (Shinoda et al.), 5,674,553 (Shinoda et al.), 5,745,086 (Weber), and 5,736,815 (Amemiya), all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

This invention particularly relates to the use of microshells containing an ionizable gas in a gas discharge plasma display positioned on a single substrate or monolithic structure. The single substrate display may comprise a two electrode columnar structure or a three (or more) electrode surface discharge structure. Single-substrate or monolithic plasma display panel structures are disclosed by U.S. Pat. Nos. 3,646,384 (Lay), 3,860,846 (Mayer), 3,964,050 (Mayer), 4,106,009 (Dick), 4,164,678 (Biazzo et al.), and 4,638,218 (Shinoda et al.), all cited above and incorporated herein by reference.

RELATED PRIOR ART SPHERES, BEADS, AMPOULES, CAPSULES

U.S. Pat. No. 2,644,113 (Etzkorn), incorporated herein by reference, discloses ampoules or hollow glass beads containing luminescent gases that emit a colored light. In one embodiment, the ampoules are used to radiate ultraviolet light onto a phosphor external to the ampoule itself.

U.S. Pat. No. 3,848,248 (MacIntyre), incorporated herein by reference, discloses the embedding of gas filled beads in a transparent dielectric. The beads are filled with a gas using a capillary. The external shell of the beads may contain phosphor.

U.S. Pat. No. 4,035,690 (Roeber) discloses a plasma panel display with a plasma forming gas encapsulated in clear glass spheres. Roeber used commercially available glass spheres containing gases such as air, $SO_2$ or $CO_2$ at pressures of 0.2 to 0.3 atmosphere. Roeber discloses the removal of these residual gases by heating the glass spheres at an elevated temperature to drive out the gases through the heated walls of the glass sphere. Roeber obtains different colors from the glass spheres by filling each sphere with a gas mixture which emits a color upon discharge and/or by using a glass sphere made from colored glass.

Japanese Patent 11238469A, published Aug. 31, 1999, by Tsuruoka Yoshiaki of Dainippon discloses a plasma display panel containing a gas capsule. The gas capsule is provided with a rupturable part which ruptures when it absorbs a laser beam.

U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

SUMMARY OF THE INVENTION

In accordance with the practice of this invention, the gas discharge space within a single substrate gas discharge plasma display device comprises one or more encapsulated pixels comprising hollow microshells, each hollow microshell having an inner surface and an outer surface and containing an ionizable gas mixture capable of forming a gas discharge when a sufficient voltage is applied to opposing electrodes in close proximity to the microshell.

In one embodiment, this invention comprises a single substrate single color (monochrome) or multi-color gas discharge (plasma) display with microshells containing ionizable gas wherein photons from the gas discharge within a microshell excite a phosphor such that the phosphor emits light in the visible and/or invisible spectrum. The invention is described in detail hereinafter with reference to a plasma display panel (PDP) in an AC gas discharge (plasma) display.

The practice of this invention results in a single substrate plasma display device with a robust encapsulated cell structure that is free from problems associated with dimensional tolerance requirements in the prior art.

The practice of this invention also allows for encapsulated pixel plasma display devices to be produced with simple alignment methods using non-rigid materials such as plastic.

The practice of this invention also allows for the production of flexible or bendable displays with encapsulated pixel elements.

The practice of this invention allows for a low cost continuous roll manufacturing process by separating the production of light producing encapsulated pixel elements from the production of the substrate.

The practice of this invention allows for effective electrical contact between electrodes and the microshells of the encapsulated pixel device.

The practice of this invention allows for visual inspection and rework of the interconnect between the microshells and the electrodes.

The practice of this invention allows for the addressing of multiple rows simultaneously without splitting the screen as is done with conventional plasma displays.

The practice of this invention allows for reduction of false contour as is often observed in a standard plasma display.

BRIEF DESCRIPTION OF THE DRAWINGS

FIGS. 3A, 3B, and 3C are tables mapping the addressing of the physical locations of microshells in a PDP.

DETAILED DESCRIPTION OF THE DRAWINGS

FIGS. 1A, 1B, 1C, and 1D show one preferred cell configuration for a plasma display device using a single flexible substrate and gas encapsulated microshells, each in contact with two electrodes.

Figure 1A:
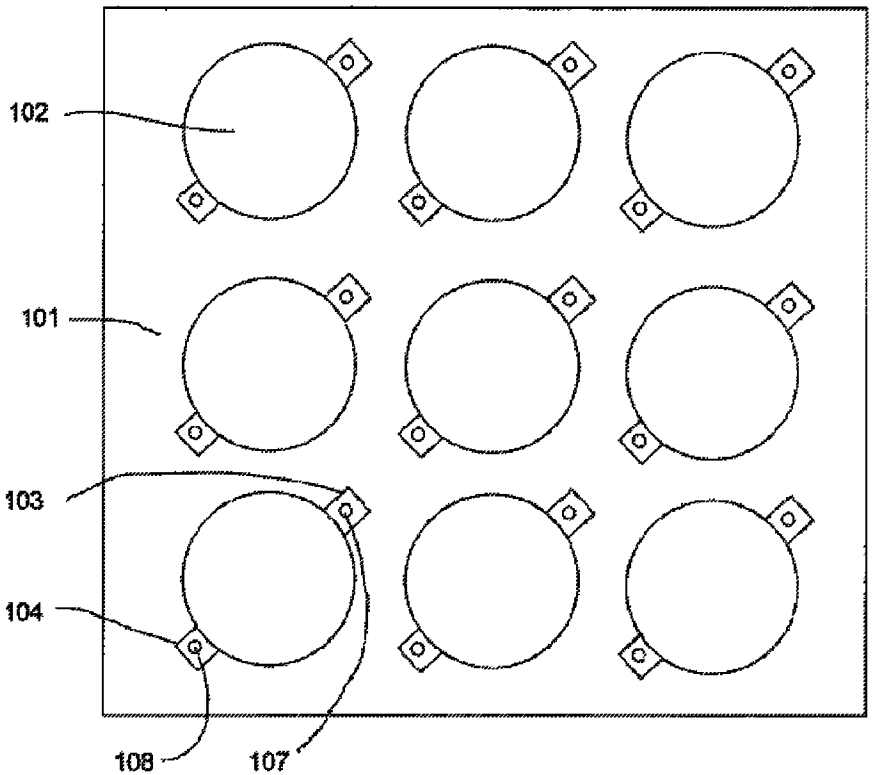
FIGS. 1A, 1B, 1C, and 1D are views of a two-electrode single substrate plasma display with gas encapsulating microshells positioned in wells and held in place by an adhesive material on the back of the substrate.

FIG. 1A shows the front viewing side of a substrate 101. The microshell 102 is in contact with surface electrode pads or traces 103 and 104 which reside on substrate 101 and are connected to the internal layers of the substrate through electrode vias 107 and 108.

Figure 1B:
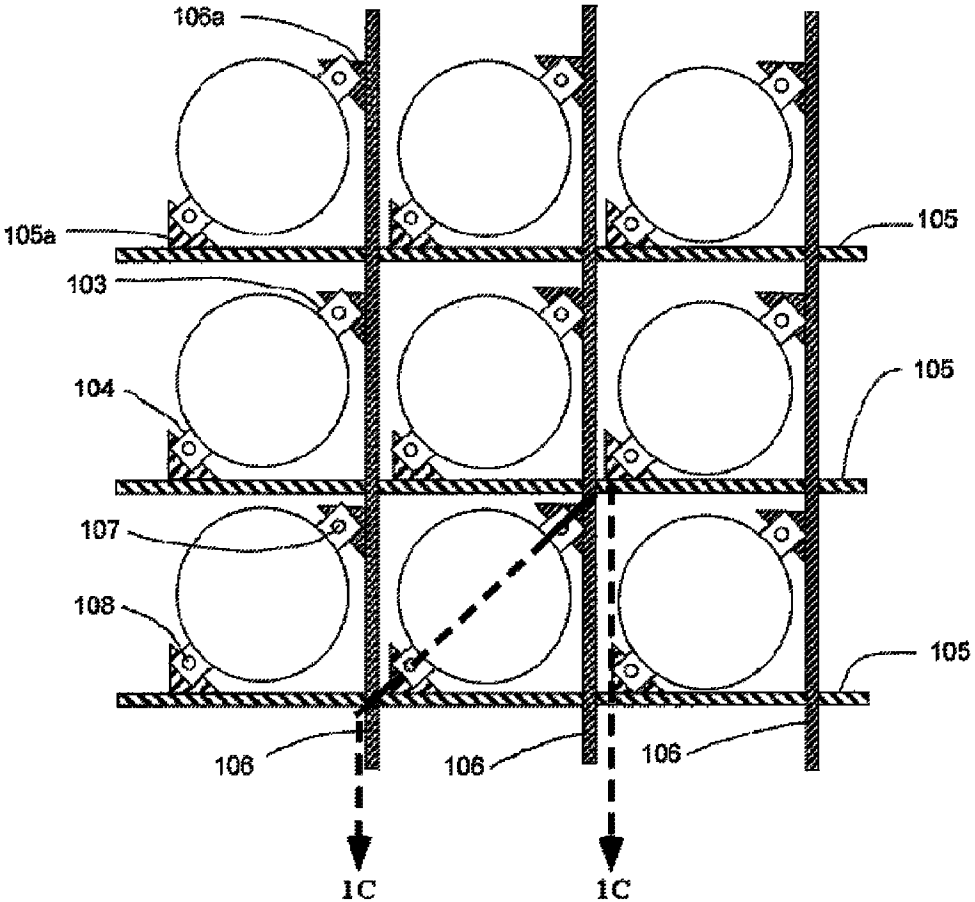

FIG. 1B shows a top view of the electrode layers within the substrate 101 (not shown) with reference to the microshell 102. Row electrodes 105 and column electrodes 106 are on different internal layers. The row and column electrodes are orthogonal to one another and form an addressable matrix. Bridge conductor 105*a* is an extension of row electrode 105 to via 108. Bridge conductor 106*a* is an extension of column electrode 106 to via 107.

Figure 1C:
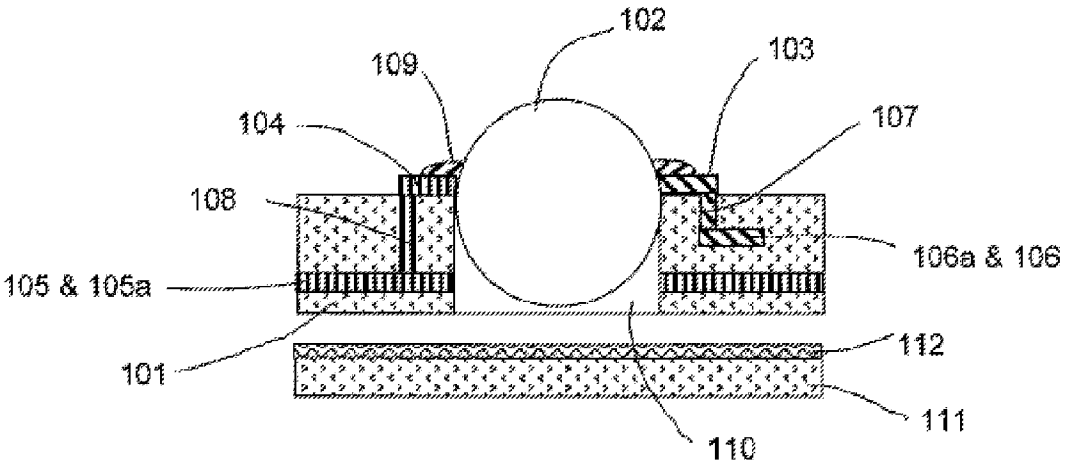

FIG. 1C is a section 1C-1C view of a single microshell cell or pixel of the display before the support 111 is pressed against the adhesive 112 to create a single cell. The microshells 102 are seated in wells 110 formed in the substrate 101 at each cell site. The sectional view shows a microshell connected to a single internal column electrode 106 by via 107 containing conductive paste and connected to surface electrode pad 103. Surface electrode 103 comes to the edge of the well to contact the microshell. Similarly the microshell is connected to one internal row electrode 105 by via 108 which connects to surface electrode pad 104. Surface electrode pad 104 comes to the edge of the well to make contact with the microshell 102. Conductive paste 109 is added to the surface pads 103 and 104 to augment the connection to the microshell. The substrate 101 is adhered to a support 111 with an adhesive 112.

Figure 1D:
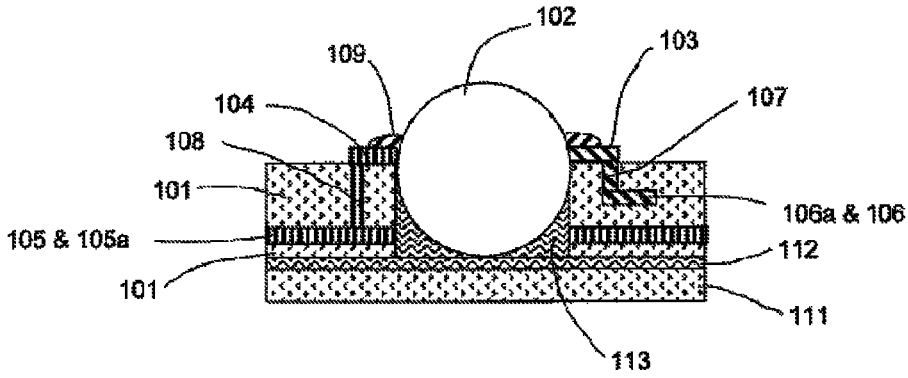

FIG. 1D shows the support 111 pressed against the adhesive 112 for a single cell. The adhesive 112 flows into the well 110 (shown in FIG. 1C) and adheres to the microshell. The flowed adhesive 112 in the well 110 is shown as 113. It conforms to the shape of the microshell 102 when the microshell is positioned in the well 110 (shown in FIG. 1C).

FIGS. 1A, 1B, 1C, and 1D illustrate a two-electrode structure. A three-electrode structure may also be used. A three-electrode single substrate gas encapsulating microshell display may be achieved through a number of configurations as discussed herein.

Figure 2A:
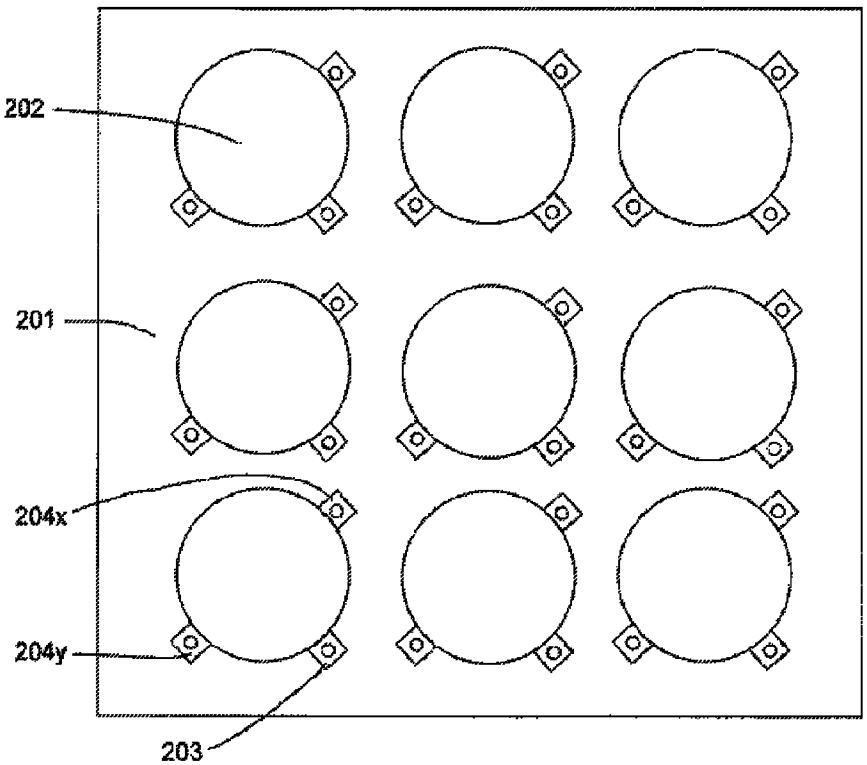
FIGS. 2A, 2B, and 2C, are views of a three-electrode single substrate plasma display with gas encapsulating microshells.
Figure 2B:
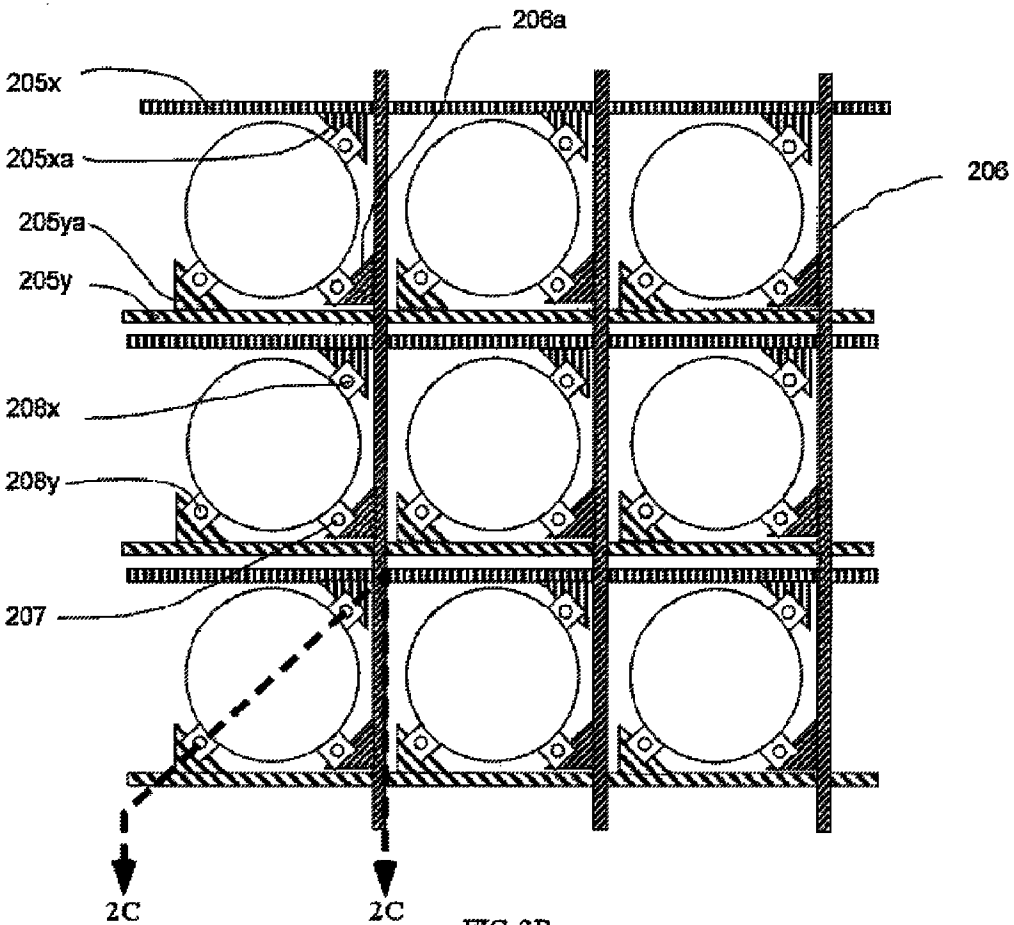
Figure 2C:
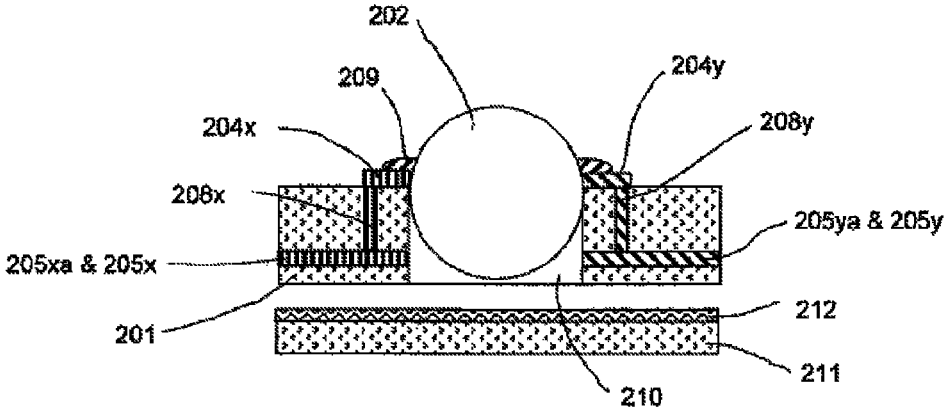

FIGS. 2A, 2B, and 2C show one preferred embodiment using a three-electrode structure. In this configuration, FIG. 2A shows the microshell 202 connected to surface electrode pads 204*x*, 204*y*, and 203. FIG. 2B is a top view of the electrode layers within the substrate (not shown) before the support 211 is pressed against the adhesive 212 to create a single cell. depicted in FIG. 2A with a grid of electrodes formed by row electrodes 205*x* on one layer, row electrodes 205*y* parallel to 205*x*, but on a different layer (as shown in FIG. 2C) and column electrodes 206. Bridge conductor 205*xa* is an extension of row electrode 205*x* to via 208*x*. Bridge conductor 205*ya* is an extension of row electrode 205*y* to via 208*y*. Bridge conductor 206*a* is an extension of column electrode 206 to via 207.

The section 2C-2C view in FIG. 2C shows the electrodes 205*x*, 205*y* and 206 (206 not shown) each in a separate plane with a single microshell 202. Surface electrode pads 204*x*, 204*y*, and 203 (203 not shown) connect by micro via 208*x*, 208*y*, and 207 (207 not shown) to their respective electrodes 205*x*, 205*y*, and 206 (206 not shown). This electrode configuration allows for three electrode addressing in which two row electrodes 205*x* and 205*y* performs the sustain and row select functions. The column electrode 206 (not shown) applies data. As shown row electrode 205*x* is located on a different plane than row electrode 205*y* and is directly underneath. In other embodiments, row electrodes 205*x* and 205*y* may be in the same plane.

Multiple electrode layers and connecting vias as shown in 1A, 1B, 1C, 1D, 2A, 2B, and 2C are more easily added to a flexible substrate than to a standard glass substrate. Multiple layers of electrodes allow for novel addressing schemes not readily achieved with a glass substrate plasma display.

FIGS. 1A, 1B, 1C, 1D, 2A, 2B, 2C illustrate a cell configuration in which the microshells are positioned in a well and held in place by an adhesive coated back. Other configurations are contemplated.

A standard plasma display is addressed one row at a time. The addressing of each row takes a finite amount of time. In order to maintain a flicker free image, the display must be updated at video rates. Therefore there is a practical limit as to how many rows a plasma display may have. In order to achieve more rows with a plasma display, often the column electrodes are split at the center of the display and the two sections are addressed from the top and from the bottom as two independent displays. This is referred to in the PDP industry as dual scan. The splitting of the PDP into two sections is disclosed in U.S. Pat. Nos. 4,233,623 (Pavliscak), 4,320,418 (Pavliscak), and 5,914,563 (Lee), all incorporated herein by reference.

Dual scan can be achieved with a microshell display by using multiple layers of column electrodes to simultaneously address multiple (two or more) row electrodes. FIG. 3A is a table that maps physical address of the display to the internal electrode configuration where the number of column (data) electrodes has been doubled. One set of column electrodes is represented as l1 through l9, and a second set of column electrodes parallel to l1 through l9, but on a different plane is represented as m1 through m9. Each set of these column electrodes connects to a unique subset of microshells, the physical location defined by rows R and columns C. For example the table in FIG. 3A shows l1 through l9 connecting to rows R1 through R4 at columns C1 through C9 and m1 through m9 connecting to rows R5 though R8 at columns C1 though C9. This allows two rows to be addressed simultaneously. In one row scan time, two rows are addressed simultaneously. Although the concept is illustrated with two rows addressed simultaneously, this may be expanded to more than two rows. By addressing two or more rows at a time, the display may be refreshed faster.

In a standard plasma display gray levels are achieved by time multiplexing. The brightness of a pixel is proportional to how many sustain pulses it experiences while in the 'on' state. One frame is composed of subfields with varying numbers of sustains. The subfields may be summed in various combinations to achieve the full compliment of unique gray levels (usually 256). Two problems that occur with this technique are false contour and motion artifact. In general both of these artifacts occur because the human eye does not integrate the subfields properly. There are several ways to alleviate this problem including increasing the update speed as described above. Another way is to separate the pixels that are changing to allow the eye to integrate over an area. By physically separating the pixels that are being addressed, changes will be less obvious to the observer. This may be done with a microshell display by taking advantage of the ability to have electrodes on multiple layers.

FIG. 3B and FIG. 3C show tables that map the physical address of the display with the electrode address. In FIG. 3B the address electrodes attach in a zig-zag pattern. For example, row scan electrode n4 alternates between rows R4 and R2. When n4 is selected to be scanned, microshells at (R4, C1), (R2, C2), and (R4, C4) are addressed. The pixels are physically separated in a zig-zag pattern. FIG. 3C shows an alternative pattern in which the pixels are diagonally addressed.

In one embodiment of this invention as illustrated in FIGS. 3A, 3B, 3C, one portion, or section of the display is addressed while another portion or section is sustained. This is referred to as Simultaneous Address and Sustain (SAS).

In accordance with the electrode connections of FIGS. 3A, 3B, and 3C, multiple layers of cells or pixels may be used to randomize the presentation of cells that are addressed simultaneously. Present PDPs allow only a single layer of metallization so each addressing event addresses a line of adjacent contiguous cells somewhere on the PDP. Multiple layers allow the cross-strap of the individual panel cells or pixels so that cells addressed during the addressing event may not be in a single line, but may be addressed on different lines at the same time. Consequently one may address different PDP sections at the same time and also address in such a way that no two adjacent cells are addressed at the same time anywhere on the panel. This randomizes any concentration of light flashes on the display and mitigates visual defects such as artifacts.

Figure 4A:
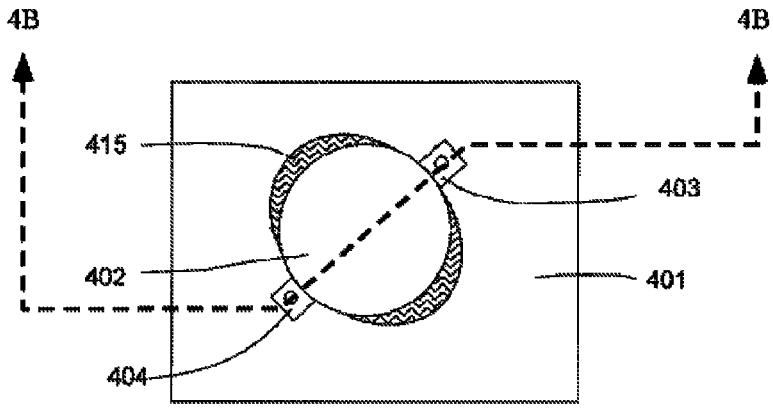
FIGS. 4A and 4B are views of a single substrate plasma display with gas encapsulating microshells positioned in a well and held in place by adhesive.
Figure 4B:
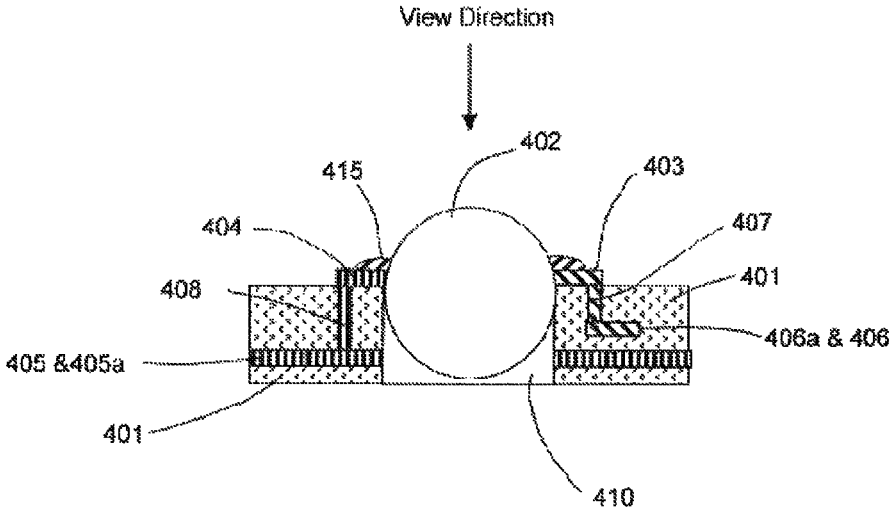

FIGS. 4A and 4B illustrate an alternate embodiment in which the adhesive backing is not used and the microshells are held in place by an adhesive applied on one side of the substrate.

FIG. 4A is a top view that shows a microshell 402 on a substrate 401 and connected to surface electrode pads 403 and 404. Adhesive 415 is applied to the microshell and substrate.

FIG. 4B is a section 4B-4B view, showing that the microshell may be viewed from both directions. Also shown in FIGS. 4A and 4B are vias 407, 408, row electrode 405, column electrode 406, and well 410. In FIG. 4B, bridge conductor 405*a* is shown in cross section with row electrode 405. Bridge conductor 406*a* is shown in cross section with column electrode 406.

Figure 5A:
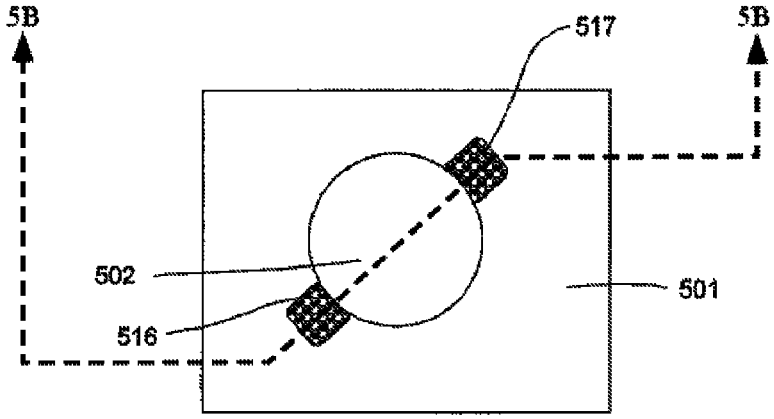
FIGS. 5A and 5B are views of a single substrate plasma display with gas encapsulated microshells positioned by an adhesive on the substrate.
Figure 5B:
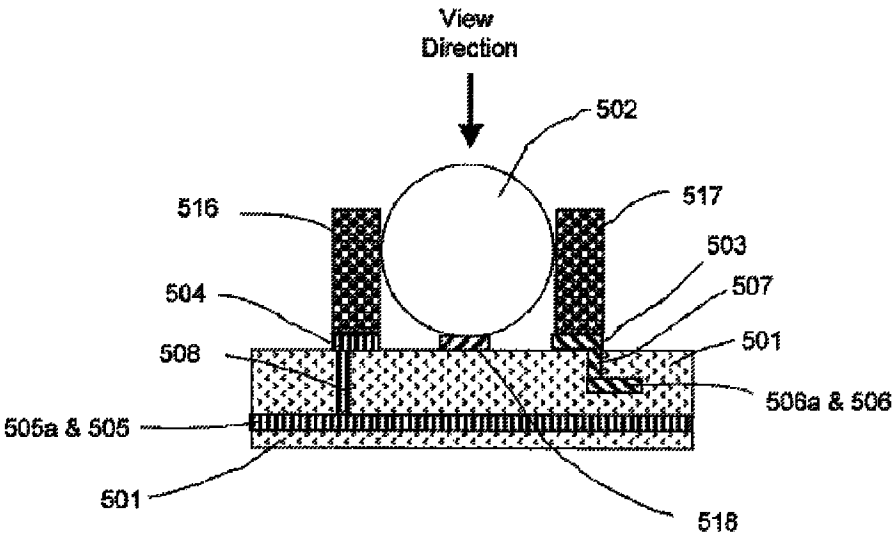

FIGS. 5A and 5B show a configuration in which the microshell is held in place by an adhesive material on the surface of the substrate and there is no positioning well. FIG. 5B shows a section 5B-5B view of one microshell 502 on a substrate 501. Adhesive 518 is applied to the substrate to position and adhere the microshell. Surface electrodes 504 and 503 do not make direct contact with the microshell. Instead conductive electrode layers 516 and 517 are built on top of the surface electrodes 504 and 503 to contact the microshells. Also shown in FIGS. 5A and 5B are vias 507, 508, row electrode 505, and column electrode 506. In FIG. 5B, bridge conductor 505*a* is shown in cross section with row electrode 505. Bridge conductor 506*a* is shown in cross section with column electrode 506.

Figure 6A:
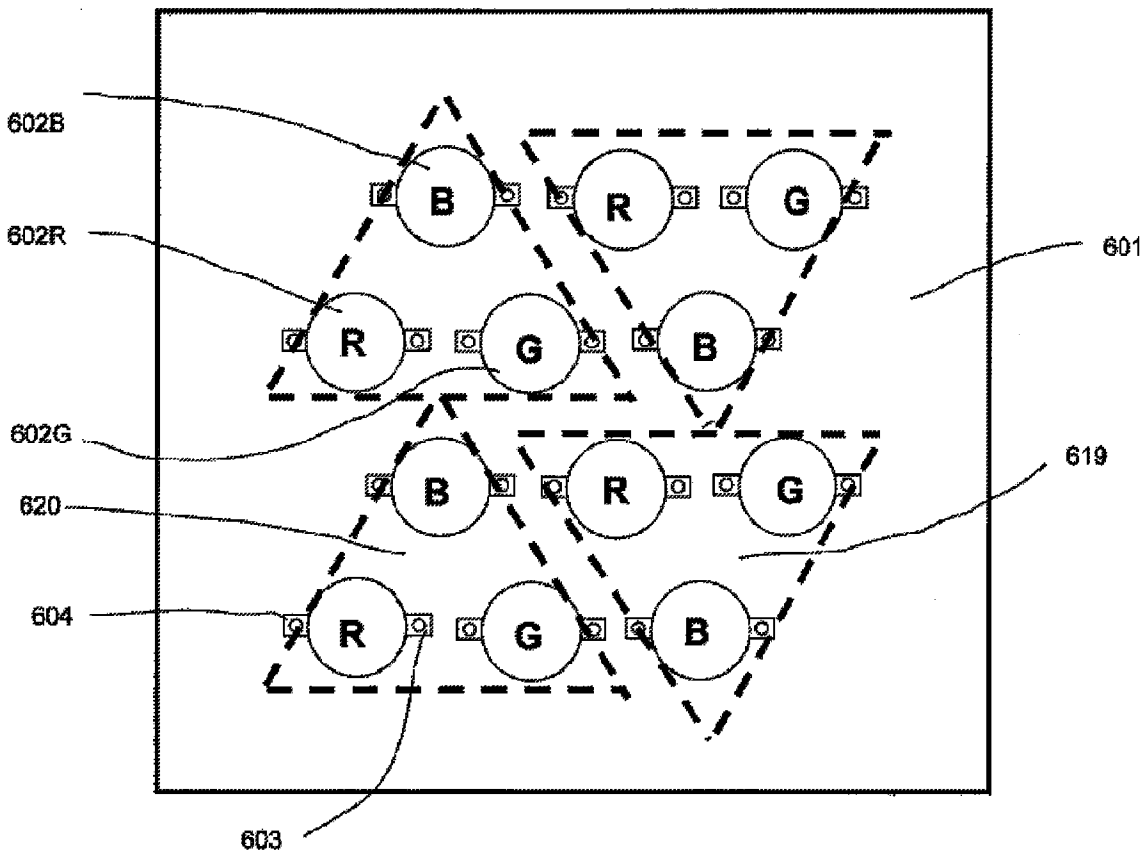
FIGS. 6A and 6B show a triad grouping of red, green, and blue microshells to produce a full color pixel.

Microshell displays may be monochrome or multi-color. In the case of a color display various configurations are envisioned. FIG. 6A shows a triad arrangement and one possible method of connecting the electrodes. In this arrangement, red, blue, and green microshell pixels are grouped to form a full color triad 619 or 620 on substrate 601.

Figure 6B:
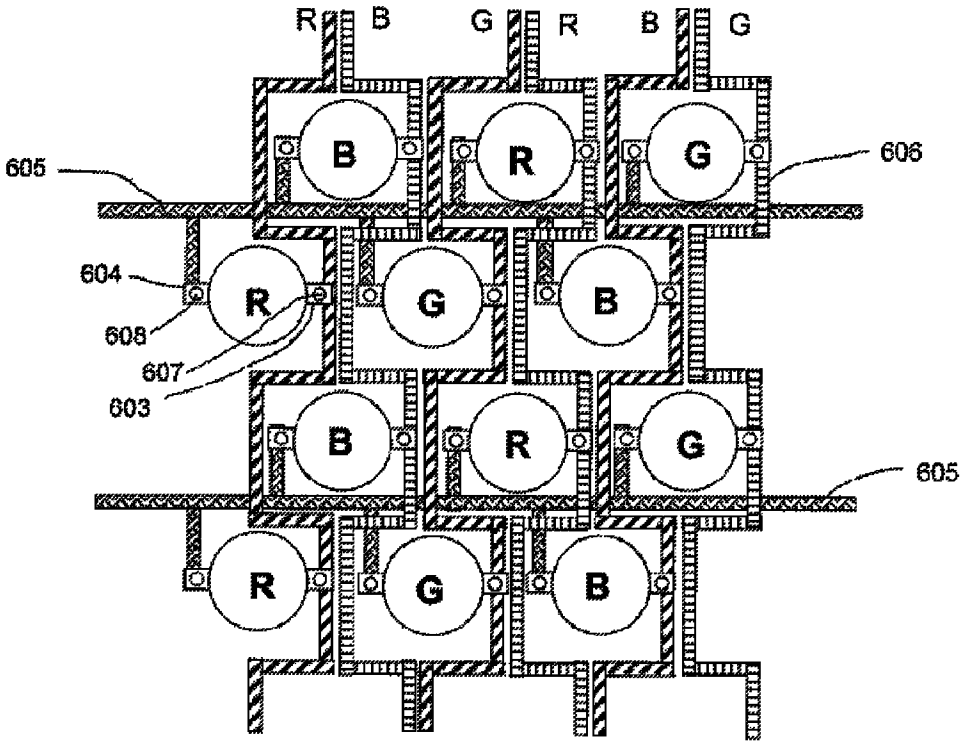

FIG. 6B is a top view of the electrode layers within the substrate (not shown) showing red green blue RGB and blue red green BRG arrangements of microshells 602R, 602G, and 602B. The row electrodes 605 and column electrodes 606 are shown in a zig zag pattern. Also shown are surface electrode pads 604, 603, and vias 607, 608.

Figure 7A:
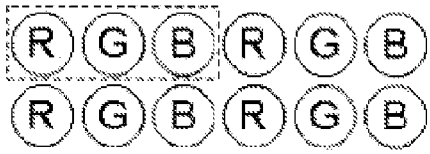
FIGS. 7A, 7B, and 7C show alternative arrangements of red, green, and blue microshells.
Figure 7B:
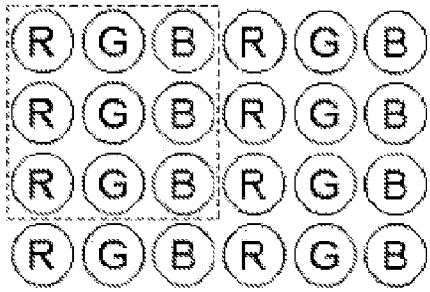
Figure 7C:
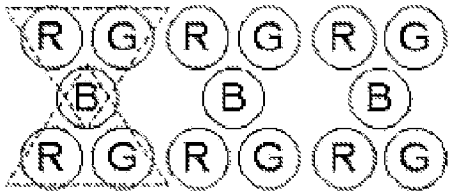

Other arrangements are possible including red, green, and blue pixels arranged linearly in a row, blocks, or triads sharing a common pixel, as shown in FIGS. 7A, 7B, and 7C. A flexible substrate with multiple electrode layers allows for many combinations.

Priming or conditioning of the gas is necessary to provide free electrons and/or charged particles. In a standard open celled structure, priming is achieved as free electrons and/or charged particles move through the open structure from cell to cell. In a display using microshells, the charged particles or electrons are not free to move from cell to cell. There are various ways to achieve priming including, additives to the gas mixture, drive waveform, radioactive sources, and light sources. Light sources are used in one embodiment of this invention. The light source may be visible or UV. In a color display, the shell of the microshell is sufficiently thin and composed of UV transmissive material to allow UV emission produced by the ionizing gas to penetrate the shell and excite an external phosphor. Because the shell is transmissive, external light such as a UV source may penetrate the shell and cause low level ionization or priming of the gas. In this invention, this is achieved with several configurations.

Figure 8:
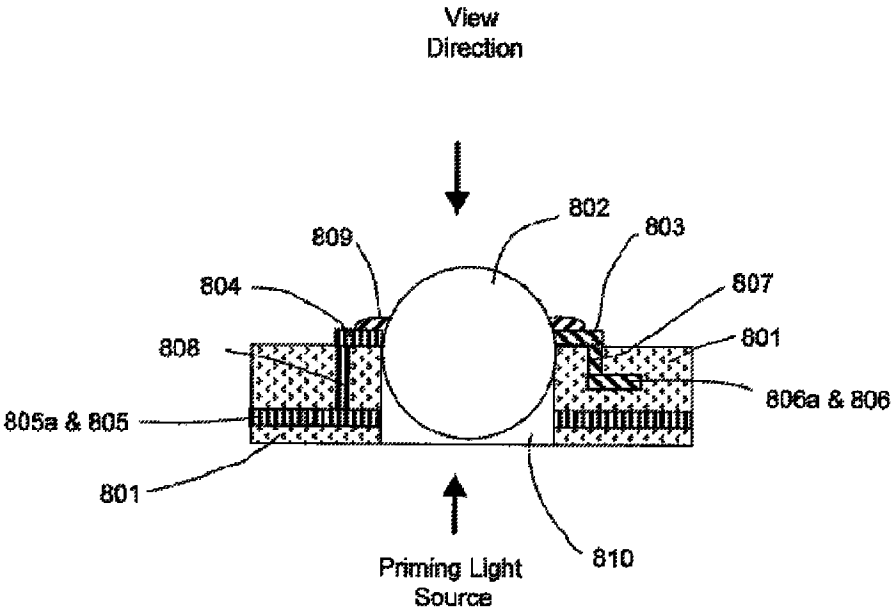
FIG. 8 shows a cross sectional view of a single substrate plasma display in which the gas encapsulating microshells are primed with an external priming light source.

In one embodiment, a priming light source may be added as a backlight behind the substrate to provide priming. The light source may take the form of standard lamps, or even microshells. FIG. 8 illustrates this embodiment with a cross section of a single microshell inserted into a well 810 in the substrate 801. Phosphors and/or adhesives may be applied to the front or viewing side of the display as shown in the prior figures. No phosphor adhesives or backing is applied to the rear or side, so maximum light is transmitted from the source to the microshell for priming.

Also shown in FIG. 8 are conductive paste 809, surface electrodes 803, 804, vias 807, 808, row electrode 805, column electrode 806, substrate 801, and well 810. In FIG. 8B, bridge conductor 805*a* is shown in cross section with row electrode 805. Bridge conductor 806*a* is shown in cross section with column electrode 806.

Figure 9:
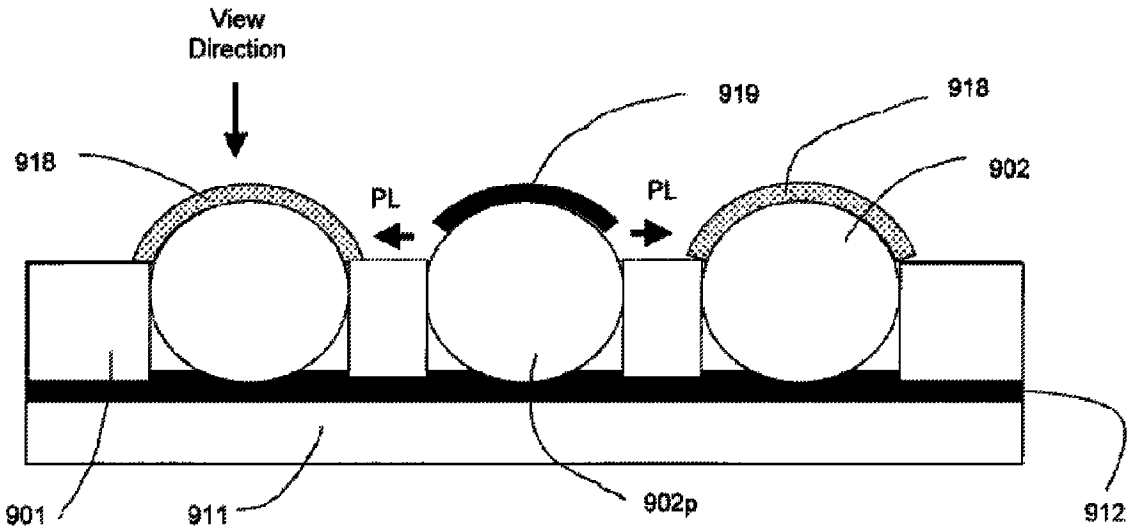
FIG. 9 shows a cross sectional view of a single substrate plasma display in which a pilot microshell emits priming light from the front (viewing side) of the substrate.
Figure 10:
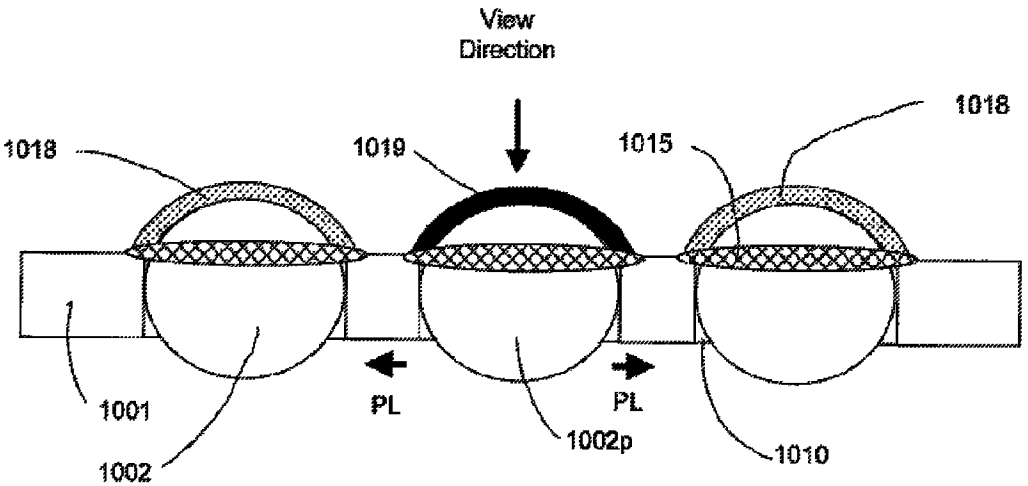
FIG. 10 shows a cross sectional view of a single substrate plasma display in which a pilot microshell emits priming light from the rear (non viewing side) of the substrate.

In another embodiment, priming light generating microshells are embedded in the substrate along side the regular spheres. FIGS. 9 and 10 illustrate this. In FIG. 9, the substrate 901 has an adhesive backing. Pilot microshell 902*p* emits priming light (PL) which penetrates the shells of the regular microshells 902. The pilot microshell 902*p* may be coated with a mask 919 on the top to shield stray light from the viewer. The microshells 902 may be covered with phosphor 918, but the phosphor should not block the primary light (PL) from penetrating the sphere. Also shown are wells 910 support 911, and adhesive 912. In FIG. 10 there is no adhesive back and light priming occurs from the back side of substrate 1001. Pilot sphere 1002*p* and regular microshells 1002 are inserted into wells 1010 and held into position with adhesive 1015. The front of the pilot sphere may be coated with a mask 1019 to shield light from the viewer, and the standard microshells may be coated with a phosphor 1018. On the backside no coating is present and priming light (PL) may penetrate the shell. In this case phosphor 1018 is applied only to the front and the back of the shell is not coated. It may be advantageous to drive the pilot microshells continuously so as to continuously produce photons for priming.

Figure 11A:
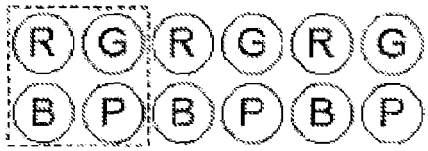
FIGS. 11A, 11B, and 11C show alternative arrangements of red, green, blue, and pilot microshells to produce a full color pixel.
Figure 11B:
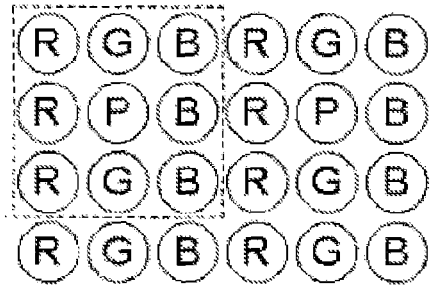
Figure 11C:
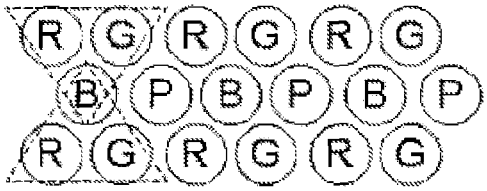

FIGS. 11A, 11B, and 11C illustrate an embodiment of a color display employing pilot microshells with red, green, and blue microshells. R denotes a red microshell, G denotes a green microshell, B denotes a blue microshell and P denotes a pilot microshell. In FIG. 11C the pilot microshell may be equidistant from all the neighbors it is to prime.

Figure 12:
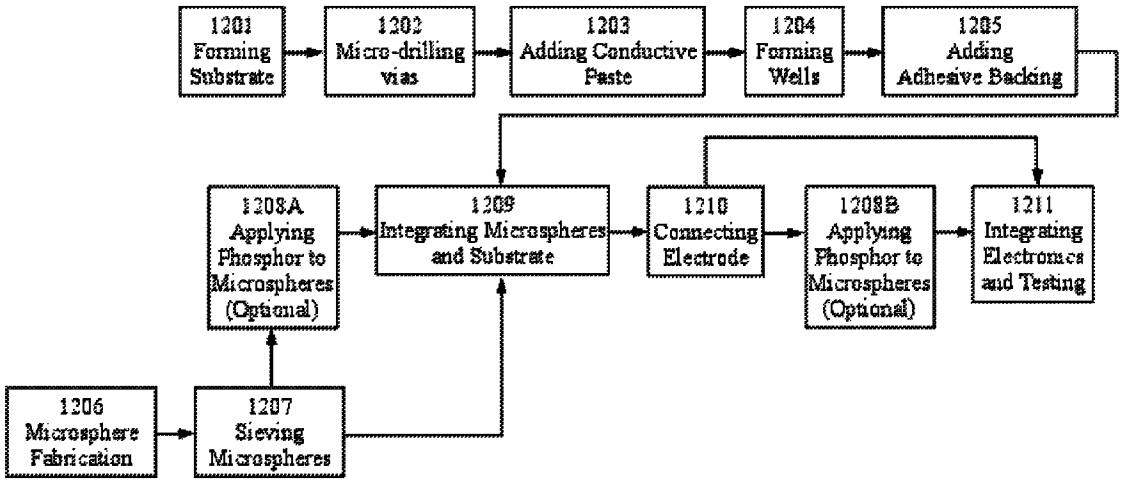
FIG. 12 is a block diagram of a process to produce a single substrate plasma display with microshells.

FIG. 12 is a block diagram that illustrates a process by which the display device may be fabricated.

FIG. 12 shows steps for one method of fabricating the display device. These steps as presented in FIG. 12 are:

1201 Forming of substrate
1202 Micro-drilling of vias
1203 Adding of conductive paste
1204 Forming of wells
1205 Adding adhesive backing
1206 Microshell fabrication
1207 Sieving microshells
1208A and/or 1208B, Applying phosphor to microshells
1209 Integrating of microshells and substrates
1210 Connecting electrodes
1211 Integrating electronics and testing In one embodiment, the substrate is made from a flexible material such as a plastic or polymer for example Mylar® or Kapton®. Mylar® is a polyester plastic film available in plastic film or sheet form in a variety of gauges. Kapton® is made from polyimide.

In one embodiment, web manufacturing processes are used. Web manufacturing process have migrated from printing and textile industry to electronic industries such as flex circuits, and most recently are being used for flat panel display substrates. Web manufacture generally involves a rolled flexible substrate up to 1000 feet in length and several feet in width. This flexible substrate, often called a "web", passes over rollers and through various chambers wherein inks or other chemicals are deposited on the substrate to produce a printed or coated product.

The practice of this invention uses micro-fabrication techniques, including micro jet printing and micro-laser cutting. Micro-jet printers are used in industry to apply small controlled amounts of various substances such as conductive ink, adhesives, or phosphors to a substrate. Micro-laser cutters make precision cuts, etches, and holes in various substrate materials.

In the practice of this invention, the flexible substrate is formed from Mylar® or Kapton® or any other suitable flexible insulative material. The electrodes are formed from some suitably conductive material such as ITO, gold, or copper. This conductive material is deposited on the substrate and patterning is carried out with standard industry photolithography techniques. Multiple conducting layers as shown in FIGS. 1A, 1B, 1C, 1D, 2A, 2B, and 2C may be procured to specification from a variety of manufacturers. These flexible electrode matrix substrates may be procured in 1000-ft rolls for a continuous roll-to-roll process or procured already cut to size for a batch process. In addition to the patterning of the electrode matrix, the multi-layer substrate may also have the patterning for drive electronics. In this case, the row and column drivers are applied directly to the substrate, and the costly high definition interconnect is eliminated. Micro-vias of the order of 5 to 20 microns in diameter are formed with a laser to cut a channel between the surface electrode and the buried electrode. The micro-vias are then filled with conductive paste. For larger size displays with large pixels, greater diameter vias may be formed using etching techniques. The microshells may be located directly on the substrate surface or positioned in wells formed in the substrate. Wells are cut or etched into the flexible substrate to position the microshells. The wells are somewhat large compared to the micro-vias. They may be formed by laser cutting, but chemical etch or other methods may be used. After the wells are formed, the flexible electrode matrix substrate is adhered to a soft foam backed adhesive sheet. Pressure is applied to sandwich the two sheets tightly together and to encourage the adhesive to ooze up into the wells. Microshells close in diameter to the wells are brushed, dusted, or agitated over the substrate so that they tend to fall into the wells and stick to the adhesive. Pressure may be applied by a roller or other means to insure that the microshells are nested firmly in the wells. Conductive adhesive may be applied by micro-jet techniques between the surface electrodes and the microshell surface to eliminate air gap. However, this may not be necessary if the microshells are selected to be slightly larger in diameter than the well diameter. Various colors may be achieved by selection of gas, microshell material, and luminescent materials such as phosphor. Phosphor may be added to the inside of the shell when it is processed or added to the outside of the shell. In the best mode, the phosphor is on the outer surface of the shell. Phosphor may be added to the outer shell in a variety of ways that are compatible with the roll-to-roll process. Phosphor may be inserted into the well with ink jet or microdropper techniques. Alternatively, phosphor may be coated over the entire sphere before it is inserted into the well. Phosphor may be added to the top of the microshells after they are positioned in the wells.

If an adhesive back is not used as in FIG. 4B, the microshells may be brushed, agitated, blown, or vacuumed to encourage them into the wells. After the microshells are positioned in the wells, microdrops of conductive adhesive are applied to eliminate air gaps between the surface conductor and the microshell. An adhesive may be applied to further secure the microshells in place.

In FIGS. 5A and 5B there is no hole to position the microshell. Microdrops of adhesive are applied to the substrate to position the microshell on the substrate. Electrodes are built up to meet the microshell with standard ink jet techniques.

Figure 13:
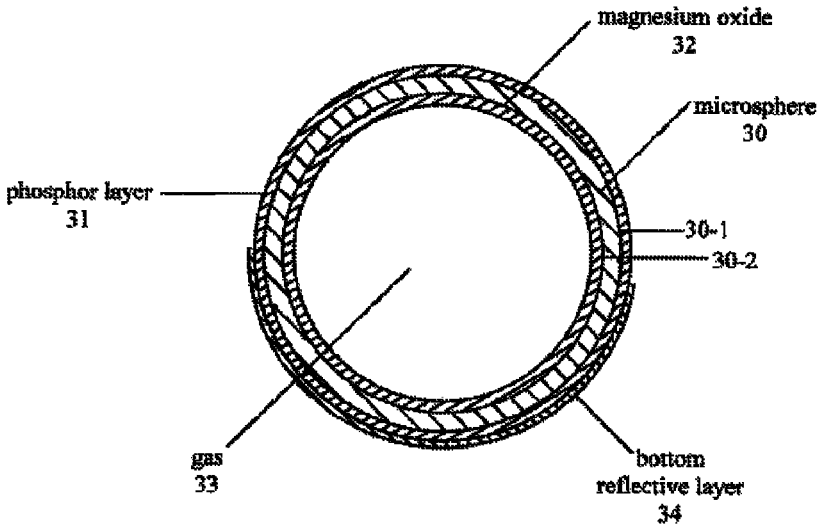
FIG. 13 shows a cross-sectional view of a microshell embodiment.

FIG. 13 shows a cross-sectional view of a best embodiment and mode of the microshell 30 with external surface 30-1 and internal surface 30-2, an external phosphor layer 31, internal magnesium oxide layer 32, ionizable gas 33, and an external bottom reflective layer 34.

The bottom reflective layer 34 is optional and, when used, will typically cover about half of the phosphor layer 31 on the external surface 30A. This bottom reflective layer 34 will reflect light upward that would otherwise escape and increase the brightness of the display.

Magnesium oxide increases the ionization level through secondary electron emission that in turn leads to reduced gas discharge voltages. The magnesium oxide layer 32 on the inner surface 30-1 of the microshell 30 is separate from the phosphor which is located on external surface 30-2 of the microshell 30. The thickness of the magnesium oxide is about 250 Angstrom Units to 10,000 Angstrom Units (Å). Magnesium oxide may be incorporated into the shell. The shell may be also made substantially of magnesium oxide.

Magnesium oxide is susceptible to contamination. To avoid contamination, gas discharge (plasma) displays are assembled in clean rooms that are expensive to construct and maintain. In traditional plasma panel production, magnesium oxide is typically applied to an entire substrate surface and is vulnerable to contamination. In FIG. 13 the magnesium oxide layer 32 is on the inside surface 30-1 of the microshell 30 and exposure of the magnesium oxide to contamination is minimized.

The magnesium oxide layer 32 may be applied to the inside of the microshell 30-1 by using a process similar to the technique disclosed by U.S. Pat. No. 4,303,732 (Torobin). In this process, magnesium vapor is incorporated as part of the ionizable gases introduced into the microshell while the microshell is at an elevated temperature.

In some embodiments the magnesium oxide may be present as particles in the gas. Other secondary electron materials may be used in place of or in combination with magnesium oxide. In one embodiment hereof, the secondary electron material is introduced into the gas by means of a fluidized bed.

Figure 14:
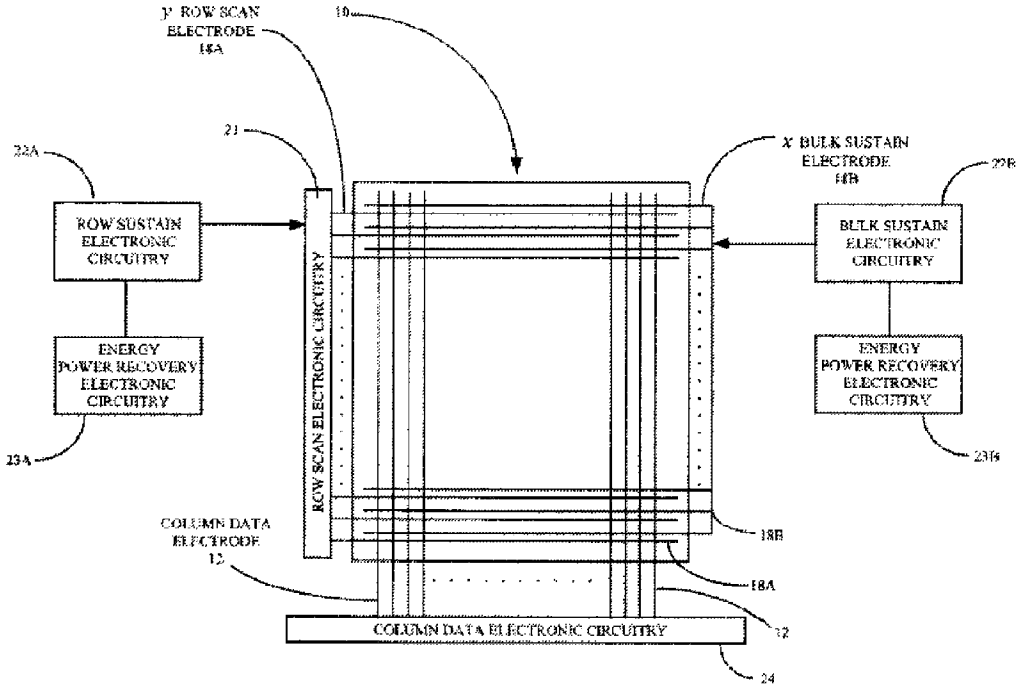
FIG. 14 shows a block diagram for driving an AC gas discharge plasma display with microshells.

FIG. 14 is a block diagram of a display panel 10 with electronic circuitry 21 for y row scan electrodes 18A, bulk sustain electronic circuitry 22B for x bulk sustain electrode 18B and column data electronic circuitry 24 for the column data electrodes 12.

There is also shown row sustain electronic circuitry 22A with an energy power recovery electronic circuit 23A. There is also shown energy power recovery electronic circuitry 23B for the bulk sustain electronic circuitry 22B.

Figure 15:
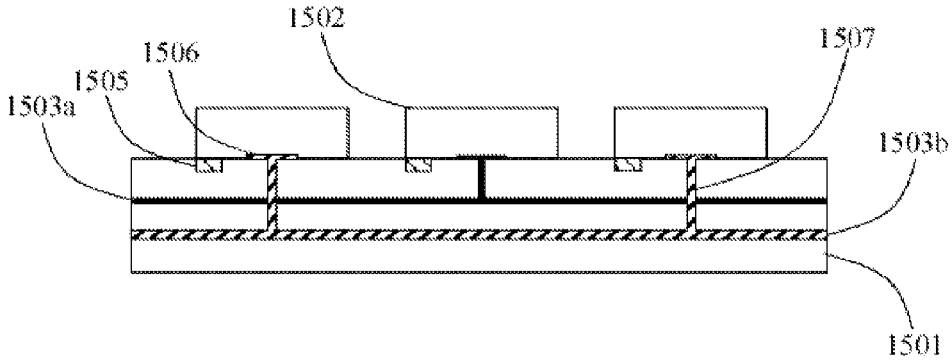
FIG. 15 shows a cross-sectional view of a dual scan plasma display.

FIG. 15 shows a cross-sectional view of a dual scan plasma display. Dual scan can be achieved with a microshell display by using multiple layers of column electrodes to simultaneously address multiple (two or more) row electrodes. FIG. 15 illustrates a microshell 1502 mounted on substrate 1501. The substrate 1501 has surface column electrode attachment 1506 and row electrode 1505. Contained within substrate 1501 is column via 1507. The substrate is comprised of multiple layers containing column electrodes 1503*a* and 1503*b*, which are located on different layers of the substrate 1501.

A basic electronics architecture for addressing and sustaining a surface discharge AC plasma display is called Address Display Separately (ADS). The ADS architecture may be used for a monochrome or multi-color display. The ADS architecture is disclosed in a number of Fujitsu patents including U.S. Pat. Nos. 5,541,618 (Shinoda), 5,724,054 (Shinoda), 5,446,344 (Kanazawa), and Shinoda et al. '500 referenced above. ADS is a basic electronic architecture used in the AC plasma display industry for the manufacture of monitors and televisions.

The ADS method of addressing and sustaining a surface discharge display as disclosed in Shinoda '618 and Shinoda '054 sustains the entire panel (all rows) after the addressing of the entire panel. The addressing and sustaining are done separately and are not done simultaneously.

Another electronic architecture is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform.

Such address pulses may be on top of the sustain and/or on a sustain notch or pedestal. See for example U.S. Pat. Nos. 3,801,861 (Petty et al.) and 3,803,449 (Schmersal). FIGS. 1 and 3 of the Shinoda '054 ADS patent discloses AWD architecture as prior art.

The AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as Address While Display (AWD). See High-Luminance and High-Contrast HDTV PDP with Overlapping Driving Scheme, J. Ryeom et al., pages 743 to 746, *Proceedings of the Sixth International Display Workshops*, IDW 99, Dec. 1-3, 1999, Sendai, Japan. AWD is also disclosed in U.S. Pat. No. 6,208,081 (Eo et al.). A variation of AWD with a Multiple Addressing in a Single Sustain (MASS) is disclosed in U.S. Pat. Nos. 6,198,476 (Hong et al.) and 5,914,563 (Lee et al.).

The electronics architecture used in FIG. 14 is ADS as described in Shinoda '618 and '054. In addition, other architectures as described herein and known in the prior art may be utilized.

Examples of energy recovery architecture and circuits are well known in the prior art. These include U.S. Pat. Nos. 4,772,884 (Weber et al.), 4,866,349 (Weber et al.), 5,081,400 (Weber et al.), 5,438,290 (Tanaka), 5,642,018 (Marcotte), 5,670,974 (Ohba et al.), 5,808,420 (Rilly et al.) and 5,828,353 (Kishi et al.), all incorporated herein by reference.

Slow rise slopes or ramps may be used in the practice of this invention. The prior art discloses slow rise slopes or ramps for the addressing of AC plasma displays. The early patents include U.S. Pat. Nos. 4,063,131 (Miller), 4,087,805 (Miller), 4,087,807 (Miavecz), 4,611,203 (Criscimagna et al.), and 4,683,470 (Criscimagna et al.), all incorporated herein by reference.

An architecture for a slow ramp reset voltage is disclosed in U.S. Pat. Nos. 5,745,086 (Weber), 6,738,033 (Hibino et al.), and 6,900,598 (Hibino et al.), all incorporated herein by reference. Weber '086 discloses positive or negative ramp voltages that exhibit a slope that is set to assure that current flow through each display pixel site remains in a positive resistance region of the gas's discharge characteristics. The slow ramp architecture is disclosed in FIG. 11 of Weber '086 in combination with the Fujitsu ADS. PCT Patent Application WO 00/30065 filed by Junichi Hibino et al. of Matsushita also discloses architecture for a slow ramp reset voltage and is incorporated herein by reference.

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Development of New Driving Method for AC-PDPs by Tokunaga et al. of Pioneer *Proceedings of the Sixth International Display Workshops*, IDW 99, pages 787-790, Dec. 1-3, 1999, Sendai, Japan. Also see European Patent Application EP 1020838A1 by Tokunaga et al. of Pioneer. The CLEAR techniques disclosed in the above Pioneer IDW 99 publication and EP 1020838A1 are incorporated herein by reference.

In the practice of this invention, it is contemplated that SAS may be combined with a CLEAR or like technique as required for the reduction of motion and visual artifacts. SAS may also be used with the slope ramp address.

SAS in combination with slow ramp allows for a larger number of sustain cycles per frame. This allows for a brighter display or alternatively more subfields per display. This also improves the PDP operating margin (window) due to more time allowed for the various overhead functions. The ADS waveforms may be used with SAS to address one PDP section while sustaining another PDP section.

The microshells may be constructed of any suitable material. In one embodiment of this invention, the microshell is made of glass, ceramic, quartz, or like amorphous and/or crystalline materials including mixtures of such.

In other embodiments it is contemplated that the microshell may be made of plastic, metal, metalloid, or other such materials including mixtures or combinations thereof.

Glasses made of inorganic compounds of metals and metalloids are contemplated, such as oxides, silicates, borates, and phosphates of titanium, zirconium, hafnium, gallium, silicon, aluminum, lead, zinc, boron, magnesium, and so forth.

In one specific embodiment of this invention, the microshell is made of an aluminate silicate glass or contains a layer of aluminate silicate glass. When the ionizable gas mixture contains helium, the aluminate silicate glasses are especially beneficial in preventing the escaping of helium.

It is also contemplated that the microshell shell may be made of other glasses including lead silicates, lead phosphates, lead oxides, borosilicates, alkali silicates, aluminum oxides, soda lime glasses, and pure vitreous silica.

For secondary electron emission a microshell may be made in whole or in part from one or more materials such as magnesium oxide having a sufficient Townsend coefficient. These include inorganic compounds of magnesium, calcium, strontium, barium, gallium, lead, and the rare earths especially lanthanum, cerium, actinium, and thorium. The contemplated inorganic compounds include oxides, silicates, nitrides, carbides, borides, and other inorganic compounds of the above and other elements.

The use of secondary electron materials in a plasma display is disclosed in U.S. Pat. No. 3,716,742 (Nakayama et al.). The use of Group IIA compounds including magnesium oxide is disclosed in U.S. Pat. Nos. 3,836,393 and 3,846,171. The use of rare earth compounds in an AC plasma display is disclosed in U.S. Pat. Nos. 4,126,807, 4,126,809, and 4,494,038, all issued to Donald K. Wedding et al., all incorporated herein by reference. Lead oxide may also be used as a secondary electron material.

In the best embodiment and mode contemplated for the practice of this invention, the secondary electron emission material is magnesium oxide on part or all of the internal surface of a microshell. The secondary electron emission material may also be on the external surface. The entire microshell may be made of a secondary electronic material such as magnesium oxide. A secondary electron material may also be dispersed or suspended as particles within the ionizable gas. As disclosed hereinafter, phosphor particles may also be dispersed or suspended in the gas, or may be affixed to the inner or external surface of the microshell.

The hollow microshells may be formed and filled with an ionizable gas mixture, for example as disclosed in U.S. Pat. No. 5,500,287 (Henderson) which is incorporated herein by reference. In Henderson '287, the hollow microshells are formed by dissolving a permeant gas (or gases) into glass frit particles. The gas permeated frit particles are then heated at a high temperature sufficient to blow the frit particles into hollow microshells containing the permeant gases. The gases may be subsequently out-permeated and evacuated from the hollow sphere as described in step D in column 3 of Henderson. In the practice of this invention, a portion of the gas or gases is not out-permeated and is retained within the hollow microshell to provide a hollow microshell containing an ionizable gas. U.S. Pat. No. 5,501,871 (Henderson) also describes the formation of hollow microshells and is incorporated herein by reference.

In one embodiment of this invention, glass microshells are produced as disclosed in U.S. Pat. No. 4,415,512 (Torobin) by a method which comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on the molten glass cylinder so as to close and detach the elongated cylinder from the coaxial blowing nozzle. Surface tension forces acting on the detached cylinder form the latter into a spherical shape which is rapidly cooled and solidified by cooling means to form the glass microshell.

The blowing gas can be an ionizable gas mixture which fills the formed microshell. The blowing gas can carry magnesium oxide or other secondary electron material which is dispersed or deposited inside the microshell. The secondary electron material may be introduced into the gas by flowing the gas through a fluid bed of the material.

The above method including apparatus is disclosed in U.S. Pat. No. 4,415,512 (Torobin) which is incorporated herein by reference. In one method of producing the microshells, the ambient pressure external to the blowing nozzle is maintained at a super atmospheric pressure. The ambient pressure external to the blowing nozzle will be such that it substantially balances, but is slightly less than the blowing gas pressure. Such a method is disclosed by U.S. Pat. No. 4,303,432 (Torobin) and WO 8000438A1 (Torobin), both incorporated herein by reference. The microshells may also be produced using a centrifuge apparatus and method as disclosed by U.S. Pat. No. 4,303,433 (Torobin) and WO8000695A1 (Torobin), both incorporated herein by reference.

Other methods for forming microshells of glass, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061. All of the above Torobin patents disclosing methods and apparatus for forming microshells are incorporated herein by reference.

Other methods for forming hollow microshells are disclosed in the prior art including U.S. Pat. Nos. 3,607,169 (Coxe), 4,349,456 (Sowman), 3,848,248 (MacIntyre), and 4,035,690 (Roeber), all incorporated herein by reference.

The hollow microshell(s) as used in the practice of this invention contain(s) one or more ionizable gas components. As used herein, ionizable gas or gas means one or more gas components. In the practice of this invention, the gas is typically selected from a mixture of the rare gases of neon, argon, xenon, krypton, helium, and/or radon. The rare gas may be a Penning gas mixture. Other gases are contemplated including nitrogen, $CO_2$, mercury, halogens, excimers, oxygen, hydrogen, and Tritium ($T^3$).

In one embodiment, a two-component gas mixture (or composition) is used such as a mixture of argon and xenon, argon and helium, xenon and helium, neon and argon, neon and xenon, neon and helium, neon and krypton, argon and krypton, xenon and krypton, and krypton and helium.

Specific two-component gas mixtures (compositions) include about 5% to 90% atoms of argon with the balance xenon. Another two-component gas mixture is a mother gas of neon containing 0.05% to 15% atoms of xenon, argon, or krypton. This can also be a three-component gas, four-component gas, or five-component gas by using small quantities of an additional gas or gases selected from xenon, argon, krypton, and/or helium.

In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton.

In one embodiment there is used a high concentration of helium with the balance selected from one or more gases of neon, argon, xenon, and nitrogen as disclosed in U.S. Pat. No. 6,285,129 (Park) and incorporated herein by reference.

A high concentration of xenon may also be used with one or more other gases as disclosed in U.S. Pat. No. 5,770,921 (Aoki et al.), incorporated herein by reference.

In the prior art, gas discharge (plasma) displays are operated with the ionizable gas at a pressure below atmospheric. Gas pressures above atmospheric are not used because of structural problems. Higher gas pressures above atmospheric may cause the display substrates to separate, especially at elevations of 4000 feet or more above sea level. Such separation may also occur between a substrate and a viewing envelope or dome in a single substrate or monolithic plasma panel structure described hereinafter.

The gas pressure inside of the hollow sphere may be less than atmospheric. The typical sub-atmospheric pressure is about 150 to 760 Torr. However, pressures above atmospheric may be used depending upon the structural integrity of the microshell.

In one embodiment of this invention, the gas pressure inside of the microshell is less than atmospheric, about 150 to 760 Torr, typically about 350 to about 650 Torr.

In another embodiment of this invention, the gas pressure inside of the microshell is greater than atmospheric. Depending upon the structural strength of the microshell, the pressure above atmospheric may be about 1 to 250 atmospheres (760 to 190,000 Torr) or greater. Higher gas pressures increase the luminous efficiency of the plasma display.

This invention has been described with reference to a single substrate or monolithic gas discharge display. However, in other embodiments, the microshells may be positioned within a dual substrate plasma display structure. One or more microshells may be positioned inside of a gas discharge (plasma) display device. As disclosed and illustrated in the gas discharge display patents cited above and incorporated herein by reference, the microshells may be positioned in one or more channels or grooves of a plasma display structure as disclosed in Shinoda et al. '500, '553, or Wedding '158. The microshells may also be positioned within a cavity, well, or hollow of a plasma display structure as disclosed by Knauer '186.

One or more hollow microshells containing the ionizable gas is located within the display panel structure in close proximity to the electrodes. The electrodes may be of any geometric shape or configuration. In one embodiment the electrodes are opposing arrays of electrodes, one array of electrodes being transverse or orthogonal to an opposing array of electrodes. The electrode arrays can be parallel, zig zag, serpentine, or like pattern as typically used in dot-matrix gas discharge (plasma) displays. The use of split or divided electrodes is contemplated as disclosed in U.S. Pat. No. 3,603,836 (Grier). The electrodes are of any suitable conductive metal or alloy including gold, silver, aluminum, or chrome-copper-chrome. If a transparent electrode is used on the viewing surface, this is typically indium tin oxide (ITO) with a conductive side or edge bus bar of silver. Other conductive bus bar materials may be used such as gold, aluminum, or chrome-copper-chrome.

The electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow microshell containing ionizable gas is positioned in the gas discharge (plasma) display device at the intersection of two opposing electrodes. When an appropriate voltage potential is applied to an opposing pair of electrodes, the ionizable gas inside of the microshell at the crossover is energized and a gas discharge occurs. Photons of light in the visible and/or invisible range are emitted by the gas discharge. Neon produces visible light (neon orange) whereas the other rare gases emit light in the non-visible ultraviolet range.

The photons of light pass through the shell or wall of the microshell and excite a phosphor located outside of the microshell. This phosphor may be located on the side wall(s) of the channel, groove, cavity, well, hollow or like structure of the discharge space. In the best embodiment contemplated in the practice of this invention, a layer, coating, or particles of phosphor is located on the exterior wall of the microshell.

The gas discharge within the channel, groove, cavity, well or hollow produces photons that excite the phosphor such that the phosphor emits light in a range visible to the human eye. Typically this is red, blue, or green light. However, phosphors may be used which emit other light such as white, pink, or yellow light. In some embodiments of this invention, the emitted light may not be visible to the human eye.

In prior art AC plasma display structures as disclosed in Wedding '158 or Shinoda et al. '500, the phosphor is located on the wall(s) or side(s) of the barriers that form the channel, groove, cavity, well, or hollow, The phosphor may also be located on the bottom of the channel, or groove as disclosed by Shinoda et al. '500 or the bottom cavity, well, or hollow as disclosed by Knauer et al. '186.

In one embodiment of this invention, microshells are positioned within the channel, groove, cavity, well, or hollow, such that photons from the gas discharge within the microshell causes the phosphor along the wall(s), side(s) or at the bottom of the channel, groove, cavity, well, or hollow, to emit light.

In another embodiment of this invention, phosphor is located on the outside surface of each microshell as shown in FIG. 3. In this embodiment, the outside surface is at least partially covered with phosphor that emits light when excited by photons from the gas discharge within the microshell.

In one embodiment, phosphor particles are dispersed and/or suspended within the ionizable gas inside each microshell. In such embodiment the phosphor particles are sufficiently small such that most of the phosphor particles remain suspended within the gas and do not precipitate or otherwise substantially collect on the inside wall of the microshell. The mean diameter of the dispersed and/or suspended phosphor particles is less than about 1 micron, typically less than 0.1 microns. Larger particles can be used depending on the size of the microshell. The phosphor particles may be introduced by means of a fluidized bed.

In the practice of this invention the microshell may be color tinted or constructed of materials that are color tinted with red, blue, green, yellow, or like pigments. This is disclosed in Roeber '690 cited above. The gas discharge may also emit color light of different wavelengths as disclosed in Roeber '690.

The use of tinted materials and/or gas discharges emitting light of different wavelengths may be used in combination with the above described phosphors and the light emitted therefrom. Optical filters may also be used.

The present gas-filling techniques used in the manufacture of gas discharge (plasma) display devices comprise introducing the gas mixture through an aperture into the device. This is a gas injection hole. The manufacture steps typically include heating and baking out the assembled device (before gas fill) at a high-elevated temperature under vacuum for 2 to 12 hours. The vacuum is obtained via external suction through a tube inserted in the aperture.

The bake out is followed by back fill of the device with an ionizable gas introduced through the tube and aperture. The tube is then sealed-off.

This bake out and gas-filling process is the major production bottleneck in the manufacture of gas discharge (plasma) display devices, requiring substantial capital equipment and a large amount of process time. For color AC plasma display panels of 40 to 50 inches in diameter, the bake out and vacuum cycle may be up to 30 hours per panel or over 30 million hours per year for a manufacturing facility producing over 1 million plasma display panels per year.

The gas-filled microshells used in this invention can be produced in large economical volumes and added to the gas discharge (plasma) display device without the necessity of bake out and gas process capital equipment. The savings in capital equipment cost and operations costs are substantial.

In a device as disclosed by Wedding '158 or Shinoda et al. '500, the microshells are conveniently added to the gas discharge space between opposing electrodes before the device is sealed. An aperture and tube can be used for bake out if needed, but the costly gas-filling operation is eliminated.

The presence of the microshells inside of the display device also adds structural support and integrity to the device. The present color AC plasma displays of 40 to 50 inches are fragile with a high breakage rate in shipment and handling.

The microshells may be of any suitable volumetric shape or geometric configuration including but not limited to spherical, oblate spheroid, prolate spheroid, capsular, bullet shape, pear and/or tear drop. In an oblate spheroid, the diameter at the polar axis is flattened and is less than the diameter at the equator. In a prolate spheroid, the diameter at the equator is less than the diameter at the polar axis such that the overall shape is elongated.

The size of the microshells used in the practice of this invention may vary over a wide range. In a gas discharge display, the average diameter of a microshell is about 2 mils to 200 mils (where one mil equals 0.001 inch) or about 50 microns to 5000 microns. Microshells can be manufactured up to 500 mils or about 12,500 microns in diameter or greater. The thickness of the wall of each hollow microshell must be sufficient to retain the gas inside, but thin enough to allow passage of photons emitted by the gas discharge. The wall thickness of plasma panel microshells should be kept as thin as practical to minimize ultraviolet (UV) absorption, but thick enough to retain sufficient strength so that the microshells can be easily handled and pressurized. The microshell wall thickness is about 1% to 5% of the diameter for the microshell.

The diameter of the microshells may be varied for different phosphors. Thus for a gas discharge display having phosphors which emit red, green, and blue light in the visible range, the microshells for the red phosphor may have an average diameter less than the average diameter of the microshells for the green or blue phosphor. Typically the average diameter of the red phosphor microshells is about 80% to 95% of the average diameter of the green phosphor microshells.

The average diameter of the blue phosphor microshells may be greater than the average diameter of the red or green phosphor microshells. Typically the average microshell diameter for the blue phosphor is about 105% to 125% of the average microshell diameter for the green phosphor and about 110% to 155% of the average diameter of the red phosphor.

In another embodiment using a high brightness green phosphor, the red and green microshell may be reversed such that the average diameter of the green phosphor microshell is about 80% to 95% of the average diameter of the red phosphor microshell. In this embodiment, the average diameter of the blue microshell is 105% to 125% of the average microshell diameter for the red phosphor and about 110% to 155% of the average diameter of the green phosphor.

The red, green, and blue microshells may also have different size diameters so as to enlarge voltage margin and improve luminance uniformity as disclosed in U.S. Patent Application Publication 2002/0041157 A1 (Heo), incorporated herein by reference. The widths of the corresponding electrodes for each RGB microshell may be of different dimensions such that an electrode is wider or more narrow for a selected phosphor as disclosed in U.S. Pat. No. 6,034,657 (Tokunaga et al.), incorporated herein by reference Photoluminescent phosphor may be located on all or part of the external surface of the microshells or on all or part of the internal surface of the microshells. The phosphor may also be particles dispersed or floating within the gas. In the best embodiment contemplated for the practice of this invention, the phosphor is on the external surface of the microshell as shown in FIG. 3.

The photoluminescent phosphor is excited by ultraviolet (UV) photons from the gas discharge and emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors.

Organic Luminescent Substances

Organic luminescent substances may be used alone or in combination with inorganic luminescent substances. Contemplated combinations include mixtures and/or selective layers of organic and inorganic substances. In accordance with one embodiment of this invention, an organic luminescent substance is located in close proximity to the enclosed gas discharge within a DC plasma-shell, so as to be excited by photons from the enclosed gas discharge.

In accordance with one preferred embodiment of this invention, an organic photoluminescent substance is positioned on at least a portion of the external surface of a DC plasma-shell, so as to be excited by photons from the gas discharge within the DC plasma-shell, such that the excited photoluminescent substance emits visible and/or invisible light.

As used herein organic luminescent substance comprises one or more organic compounds, monomers, dimers, trimers, polymers, copolymers, or like organic materials, which emit visible and/or invisible light when excited by photons from the gas discharge inside of the DC plasma-shell. Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants and/or any other organic photoluminescent material. All are collectively referred to herein as organic photoluminescent phosphor.

Organic photoluminescent phosphor substances contemplated herein include those organic light emitting diodes or devices (OLED) and organic electroluminescent (organic EL) materials, which emit light when excited by photons from the gas discharge of a gas plasma discharge. OLED and organic EL substances include the small molecule organic EL and the large molecule or polymeric OLED.

Small molecule organic EL substances are disclosed in U.S. Pat. No. 4,720,432 (VanSlyke et al.), U.S. Pat. No. 4,769,292 (Tang et al.), U.S. Pat. No. 5,151,629 (VanSlyke), U.S. Pat. No. 5,409,783 (Tang et al.), U.S. Pat. No. 5,645,948 (Shi et al.), U.S. Pat. No. 5,683,823 (Shi et al.), U.S. Pat. No. 5,755,999 (Shi et al.), U.S. Pat. No. 5,908,581 (Chen et al.), U.S. Pat. No. 5,935,720 (Chen et al.), U.S. Pat. No. 6,020,078 (Chen et al.), U.S. Pat. No. 6,069,442 (Hung et al.), U.S. Pat. No. 6,348,359 (VanSlyke et al.), and U.S. Pat. No. 6,720,090 (Young et al.), all incorporated herein by reference. The small molecule organic light emitting devices may be called SMOLED.

Large molecule or polymeric OLED substances are disclosed in U.S. Pat. No. 5,247,190 (Friend et al.), U.S. Pat. No. 5,399,502 (Friend et al.), U.S. Pat. No. 5,540,999 (Yamamoto et al.), U.S. Pat. No. 5,900,327 (Pei et al.), U.S. Pat. No. 5,804,836 (Heeger et al.), U.S. Pat. No. 5,807,627 (Friend et al.), U.S. Pat. No. 6,361,885 (Chou), and U.S. Pat. No. 6,670,645 (Grushin et al.), all incorporated herein by reference. The polymer light emitting devices may be called PLED. Organic luminescent substances also include OLEDs doped with phosphorescent compounds as disclosed in U.S. Pat. No. 6,303,238 (Thompson et al.), incorporated herein by reference. Organic photoluminescent substances are also disclosed in U.S. Patent Application Publication Nos. 2002/0101151 (Choi et al.), 2002/0063525 (Choi et al.), 2003/0003225 (Choi et al.), and 2003/0052596 (Yi et al.); U.S. Pat. No. 6,610,554 (Yi et al.) and U.S. Pat. No. 6,692,326 (Choi et al.); and International Publications WO 02/104077 and WO 03/046649, all incorporated herein by reference.

In one embodiment of this invention, the organic luminescent phosphorous substance is a color-conversion-media (CCM) that converts light (photons) emitted by the gas discharge to visible or invisible light. Examples of CCM substances include the fluorescent organic dye compounds.

In another embodiment, the organic luminescent substance is selected from a condensed or fused ring system such as a perylene compound, a perylene based compound, a perylene derivative, a perylene based monomer, dimer or trimer, a perylene based polymer, and/or a substance doped with a perylene.

Photoluminescent perylene phosphor substances are widely known in the prior art. U.S. Pat. No. 4,968,571 (Gruenbaum et al.), incorporated herein by reference, discloses photoconductive perylene materials, which may be used as photoluminescent phosphorous substances. U.S. Pat. No. 5,693,808 (Langhals), incorporated herein by reference, discloses the preparation of luminescent perylene dyes. U.S. Patent Application Publication 2004/0009367 (Hatwar), incorporated herein by reference, discloses the preparation of luminescent materials doped with fluorescent perylene dyes. U.S. Pat. No. 6,528,188 (Suzuki et al.), incorporated herein by reference, discloses the preparation and use of luminescent perylene compounds.

These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation. A material with conjugation or extended conjugation absorbs light and then transmits the light to the various conjugated bonds. Typically the number of conjugate-double bonds ranges from about 4 to about 15. Further examples of conjugate-bonded or condensed/fused benzene rings are disclosed in U.S. Pat. No. 6,614,175 (Aziz et al.) and U.S. Pat. No. 6,479,172 (Hu et al.), both incorporated herein by reference. U.S. Patent Application Publication 2004/0023010 (Bulovic et al.) incorporated herein by reference, discloses luminescent nanocrystals with organic polymers including conjugated organic polymers. Cumulene is conjugated only with carbon and hydrogen atoms. Cumulene becomes more deeply colored as the conjugation is extended. Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,348,890 (Likavec et al.), incorporated herein by reference.

The organic luminescent substance may be an organic lumophore, for example as disclosed in U.S. Pat. No. 5,354,825 (Klainer et al.), U.S. Pat. No. 5,480,723 (Klainer et al.), U.S. Pat. No. 5,700,897 (Klainer et al.), and U.S. Pat. No. 6,538,263 (Park et al.), all incorporated herein by reference. Also lumophores are disclosed in S. E. Shaheen et al., *Journal of Applied Physics*, Vol. 84, Number 4, pages 2324 to 2327, Aug. 15, 1998; J. D. Anderson et al., *Journal American Chemical Society* 1998, Vol. 120, pages 9646 to 9655; and Gyu Hyun Lee et al., *Bulletin of Korean Chemical Society,* 2002, Vol. 23, NO. 3, pages 528 to 530, all incorporated herein by reference.

Selected Specific Organic Phosphor Embodiments and Applications

The following are some specific embodiments using an organic luminescent substance such as a luminescent phosphor.

Color DC Plasma Displays Using UV 300 nm to 380 nm Excitation with Organic Phosphors The organic luminescent substance such as an organic phosphor may be excited by UV ranging from about 300 nm to about 380 nm to produce red, blue, or green emission in the visible range. The encapsulated gas is chosen to excite in this range. To improve life, the organic phosphor should be separated from the plasma discharge. This may be accomplished by applying the organic phosphor to the exterior of the shell. In this case, it is important that the shell material be selected such that it is transmissive to UV in the range of about 300 nm to about 380 nm. Suitable materials include aluminum oxides, silicon oxides, and other such materials. In the case where helium is used in the gas mixture, aluminum oxide is a desirable shell material, as it does not allow the helium to permeate.

Color DC Plasma Displays Using UV Excitation Below 300 nm with Organic Phosphors UV below 300 nm may excite organic phosphors. In this case, a xenon neon mixture of gases may produce excitation at 147 nm and 172 nm. The DC plasma-shell material must be transmissive below 300 nm. Shell materials that are transmissive to frequencies below 300 nm include silicon oxide. The thickness of the shell material must be minimized in order to maximize transmissivity.

Color DC Plasma Displays Using Visible Blue Above 380 nm with Organic Phosphors

Organic phosphors may be excited by excitation above 380 nm. The DC plasma-shell material is composed completely or partially of an inorganic blue phosphor such as Barium Magnesium Aluminate (BAM). The shell material fluoresces blue and may be up-converted to red or green with organic phosphors on the outside of the shell Infrared DC Plasma Displays In some applications it may be desirable to have DC PDP displays with DC plasma-shells that produce emission in the infrared range. This may be done with up-conversion or down-conversion phosphors as described below.

Application of Organic Phosphors

Organic phosphors may be added to a UV curable medium and applied to the DC plasma-shell with a variety of methods including jetting, spraying, brushing, sheet transfer methods, spin coating, dip coating, or screen-printing. Thin film deposition processes are contemplated including vapor phase deposition and thin film sputtering at temperatures that do not degrade the organic material. This may be done before or after the DC plasma-shell is added to a substrate or back plate.

Application of Phosphor Before DC Plasma-Shells are Added to Substrate

If organic phosphors are applied to the DC plasma-shells before such are applied to the substrate, additional steps may be necessary to place each DC plasma-shell in the correct position on the back substrate.

Application of Phosphor after DC Plasma-Shells are Added to Substrate

If the organic phosphor is applied to the DC plasma-shells after such are placed on a substrate, care must be taken to align the appropriate phosphor color with the appropriate DC plasma-shell.

Application of Phosphor after DC Plasma-Shells are Added to Substrate Self-Aligning In one embodiment, the DC plasma-shells may be used to cure the phosphor. A single color organic phosphor is completely applied to the entire substrate containing the DC plasma-shells. Next the DC plasma-shells are selectively activated to produce UV to cure the organic phosphor. The phosphor will cure on the DC plasma-shells that are activated and may be rinsed away from the DC plasma-shells that were not activated. Additional applications of phosphor of different colors may be applied using this method to coat the remaining shells. In this way the process is completely self-aligning.

Inorganic Luminescent Substances

Inorganic luminescent substances may be used alone or in combination with organic luminescent substances. Contemplated combinations include mixtures and/or selective layers of organic and/or inorganic substances. The shell may be made of inorganic luminescent substance such as a phosphor. In one embodiment the inorganic luminescent substance is incorporated into the particles forming the shell structure. Typical inorganic luminescent substances are listed below.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb.

In one mode and embodiment of this invention using a green light-emitting phosphor, there is used a green light-emitting phosphor selected from the zinc orthosilicate phosphors such as $ZnSiO_4:Mn^{2+}$. Green light-emitting zinc orthosilicates including the method of preparation are disclosed in U.S. Pat. No. 5,985,176 (Rao) which is incorporated herein by reference. These phosphors have a broad emission in the green region when excited by 147 nm and 173 nm (nanometers) radiation from the discharge of a xenon gas mixture.

In another mode and embodiment of this invention there is used a green light-emitting phosphor which is a terbium activated yttrium gadolinium borate phosphor such as (Gd, Y) $BO_3:Tb^{3+}$. Green light-emitting borate phosphors including the method of preparation are disclosed in U.S. Pat. No. 6,004,481 (Rao) which is incorporated herein by reference.

In another mode and embodiment there is used a manganese activated alkaline earth aluminate green phosphor as disclosed in U.S. Pat. No. 6,423,248 (Rao et al.), peaking at 516 nm when excited by 147 and 173 nm radiation from xenon. The particle size ranges from 0.05 to 5 microns. Rao et al. '248 is incorporated herein by reference.

Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated.

Green light-emitting terbium-activated lanthanum cerium orthophosphate phosphors are disclosed in U.S. Pat. No. 4,423,349 (Nakajima et al.) which is incorporated herein by reference. Green light-emitting lanthanum cerium terbium phosphate phosphors are disclosed in U.S. Pat. No. 5,651,920 (Chau et al.), which is incorporated herein by reference.

Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na.

In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry.

BAM and other aluminate phosphors which emit blue visible light are disclosed in U.S. Pat. Nos. 5,611,959 (Kijima et al.) and 5,998,047 (Bechtel et al.), both incorporated herein by reference. The aluminate phosphors may also be selectively coated as disclosed by Bechtel et al. '047.

Blue light-emitting phosphors may be selected from a number of divalent europium-activated aluminates such as disclosed in U.S. Pat. No. 6,096,243 (Oshio et al.) incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao) which is incorporated herein by reference.

In a best mode and embodiment of this invention using a blue-emitting phosphor, a mixture or blend of blue light-emitting phosphors is used such as a blend or complex of about 85% to 70% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference.

Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference.

Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S$:Eu and $Y_2O_3S$:Eu.

In a best mode and embodiment of this invention using a red-emitting phosphor, there is used a red light-emitting phosphor which is an europium activated yttrium gadolinium borate phosphor such as $(Y, Gd)BO_3:Eu^{3+}$. The composition and preparation of these red-emitting borate phosphors is disclosed in U.S. Pat. Nos. 6,042,747 (Rao) and 6,284,155 (Rao), both incorporated herein by reference.

These europium activated yttrium, gadolinium borate phosphors emit an orange line at 593 nm and red emission lines at 611 nm and 627 nm when excited by 147 nm and 173 nm UV radiation from the discharge of a xenon gas mixture. For television (TV) applications, it is preferred to have only the red emission lines (611 and 627 nm). The orange line (593 nm) may be minimized or eliminated with an external optical filter.

A wide range of red light-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter.

Phosphor materials which emit white light include calcium compounds such as $3Ca_3(PO_4)_2.CaF:Sb$, $3Ca_3(PO_4)_2.CaF:Mn$, $3Ca_3(PO_4)_2.CaCl:Sb$, and $3Ca_3(PO_4)_2.CaCl:Mn$.

White light-emitting phosphors are disclosed in U.S. Pat. No. 6,200,496 (Park et al.) incorporated herein by reference.

Pink light-emitting phosphors are disclosed in U.S. Pat. No. 6,200,497 (Park et al.) incorporated herein by reference. Phosphor material which emits yellow light include ZnS:Au.

In one embodiment of this invention it is contemplated using a phosphor to convert infrared radiation to visible light. This is referred to in the literature as an up-conversion phosphor. The up-conversion phosphor is typically used as a layer in combination with a phosphor which converts UV radiation to visible light. An up-conversion phosphor is disclosed in U.S. Pat. No. 6,265,825 (Asano) incorporated herein by reference.

The phosphor thickness is sufficient to absorb the UV, but thin enough to emit light with minimum attenuation. Typically the phosphor thickness is about 2 to 40 microns, preferably about 5 to 15 microns.

The dispersed or floating particles within the gas are typically spherical or needle shaped having an average size of about 0.01 to 5 microns.

The photoluminescent phosphor is excited by UV in the range of 50 to 400 nanometers. The phosphor may have a protective layer or coating which is transmissive to the excitation UV and the emitted visible light. Such include aluminum oxide or silica. Protective coatings are disclosed in Wedding '158.

Because the ionizable gas is contained within a multiplicity of microshells, it is possible to provide a custom gas at a custom pressure in each microshell for each phosphor.

In the prior art, it is necessary to select an ionizable gas mixture and gas pressure that is optimum for all phosphors used in the device such as red, blue, and green phosphors. However, this requires trade-offs because a particular gas may be optimum for a particular green phosphor, but less desirable for red or blue phosphors. In addition, trade-offs are required for the gas pressure.

In the practice of this invention, an optimum gas mixture and an optimum gas pressure may be provided for each of the selected phosphors. Thus the gas mixture and gas pressure inside the microshells may be optimized with a custom gas mixture and a custom gas pressure, each or both optimized for each phosphor emitting red, blue, green, white, pink, or yellow light. The diameter and the wall thickness of the microshell can also be adjusted and optimized for each phosphor. Depending upon the Paschen Curve (pd v. voltage) for the ionizable gas mixture, the operating voltage may be decreased by optimized changes in the pressure and diameter.

This invention has been described with reference to a plasma display panel structure having a so-called single substrate or monolithic plasma display panel structure having one substrate with or without a top or front viewing envelope or dome. Single-substrate or monolithic plasma display panel structures are well known in the prior art and are disclosed by U.S. Pat. Nos. 3,646,384 (Lay), 3,860,846 (Mayer), and 3,964,050 (Mayer), all cited above and incorporated herein by reference.

In one embodiment of this invention, the microshells are positioned on or within a single-substrate or monolithic gas discharge structure that has a flexible or bendable substrate.

The practice of this invention is not limited to flat surface displays. The microshells may be positioned or located on a conformal surface or substrate so as to conform to a predetermined shape such as a curved surface, round shape, or multiple sides.

Aspects of this invention may also be practiced with a coplanar or opposing substrate PDP as disclosed in Wedding '158 and Shinoda et al. '500 discussed above.

In the practice of this invention, the microshells may be positioned and spaced in an AC gas discharge plasma display structure so as to utilize and take advantage of the positive column of the gas discharge. The positive column is described in U.S. Pat. Nos. 6,184,848 (Weber), 7,176,628 (Wedding), 7,157,854 (Wedding), and 7,122,961 (Wedding), all incorporated herein by reference.

The microshells may be sprayed, stamped, pressed, poured, screen-printed, or otherwise applied to a surface. The surface may contain an adhesive or sticky surface.

Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge.

The microshells may contain a gaseous mixture for a gas discharge display or may contain other substances such as an electroluminescent (EL) or liquid crystal materials for use with other displays technologies including electroluminescent displays (ELD), liquid crystal displays (LCD), field emission displays (FED), electrophoretic displays, and Organic EL or Organic LED (OLED).

The use of microshells on a single flexible substrate allows the encapsulated pixel display device to be utilized in a number of applications. In one application, the device is used as a plasma shield to absorb electromagnetic radiation and to make the shielded object invisible to enemy radar. In this embodiment, a flexible sheet of microshells may be provided as a blanket over the shielded object.

As disclosed herein, this invention is not to be limited to the exact forms shown and described because changes and modifications may be made by one skilled in the art within the scope of the following claims.

The invention claimed is:

1. In a gas discharge device comprising a single substrate and a multiplicity of gas discharge cells, the improvement wherein each gas discharge cell is confined within a microshell filled with an ionizable gas, each said microshell being located on the surface of the single substrate and electrically connected to one or more electrodes, each said electrode being connected to said microshell on a side or bottom portion of the microshell so as not to obstruct viewing of the microshell from a top position.

2. The invention of claim 1 wherein two or more electrodes are respectively located on opposite sides of each microshell so as to allow a discharge across each microshell that is viewable from the top.

3. The invention of claim 2 wherein one or more electrodes is located on the bottom of each microshell.

4. The invention of claim 1 wherein there are two electrodes connected to each microshell.

5. The invention of claim 1 wherein there are three electrodes connected to each microshell.

6. A single substrate gas discharge device comprising one substrate and a multiplicity of gas discharge pixels, each pixel being defined by a microshell filled with an ionizable gas, and located on the substrate in electrical contact with two or more electrodes, each microshell containing a luminescent material, said microshells being arranged in a geometric group of four microshells, each microshell containing a different luminescent material, two or more electrodes being located on opposite sides of each microshell so as to allow a discharge across each microshell that is viewable from the top.

7. The invention of claim 6 wherein one or more electrodes is located on the bottom of each microshell.

8. The invention of claim 6 wherein there are two electrodes connected to each microshell.

9. The invention of claim 6 wherein there are three electrodes connected to each microshell.

10. A single substrate gas discharge device comprising a substrate and a multiplicity of gas discharge pixels, each pixel being within a microshell filled with an ionizable gas, each microshell being located on a surface of the substrate in electrical contact with two or more electrodes, each microshell containing luminescent material, each microshell being in a geometric group of three microshells, each microshell within the group containing a different luminescent material, said electrodes being located in opposite sides of each microshell so as to allow a discharge across each microshell that is viewable from the top.

11. The invention of claim 10 wherein each said luminescent material emits light in the visible range when activated by photons from a gas discharge.

12. The invention of claim 11 wherein the geometric group is a triad of three microshells.

13. The invention of claim 10 wherein the geometric group is a triad of three microshells, one microshell containing luminescent material that emits light in the red range of the spectrum, one microshell containing luminescent material that emits light in the green range of the spectrum, and one microshell containing luminescent material that emits light in the blue range of the spectrum.

14. The invention of claim 13 wherein the display comprises multiple triads, the microshells being arranged in all of the triads such that any triad formed by pixels in two or more adjacent triads contains microshells with three different luminescent materials.

* * * * *